US007105214B2

(12) United States Patent
Malhotra

(10) Patent No.: US 7,105,214 B2
(45) Date of Patent: Sep. 12, 2006

(54) RECORDING SHEETS CONTAINING PYRROLE, PYRROLIDINE, PYRIDINE, PIPERIDINE, HOMOPIPERIDINE, QUINOLINE, ISOQUINOLINE, QUINUCLIDINE, INDOLE, AND INDAZOLE COMPOUNDS

(75) Inventor: Shadi L. Malhotra, Mississauga (CA)

(73) Assignee: Xerox Corporation, Stamford, CT (US)

( * ) Notice: Subject to any disclaimer, the term of this patent is extended or adjusted under 35 U.S.C. 154(b) by 122 days.

(21) Appl. No.: 10/228,124

(22) Filed: Aug. 26, 2002

(65) Prior Publication Data

US 2003/0124320 A1 Jul. 3, 2003

Related U.S. Application Data

(60) Division of application No. 08/196,676, filed on Feb. 15, 1994, now Pat. No. 6,482,503, which is a continuation-in-part of application No. 08/033,917, filed on Mar. 19, 1993, now Pat. No. 5,441,795, and a continuation-in-part of application No. 08/033,918, filed on Mar. 19, 2003, now Pat. No. 5,457,486.

(51) Int. Cl.
*B41M 5/00* (2006.01)

(52) U.S. Cl. ..... 428/32.1; 428/32.14

(58) Field of Classification Search ..... 428/32.1
See application file for complete search history.

(56) References Cited

U.S. PATENT DOCUMENTS

| | | | | |
|---|---|---|---|---|
| 3,978,270 | A * | 8/1976 | Glanz et al. | 430/644 |
| 4,086,317 | A * | 4/1978 | Miyabe | |
| 4,113,282 | A * | 9/1978 | Spatz et al. | |
| 4,371,582 | A * | 2/1983 | Sugiyama et al. | 428/341 |
| 4,446,174 | A | 5/1984 | Maekawa et al. | 427/261 |
| 4,554,181 | A | 11/1985 | Cousin et al. | 427/261 |
| 4,576,867 | A | 3/1986 | Miyamoto | 428/342 |
| 4,644,376 | A * | 2/1987 | Usami et al. | 503/215 |
| 4,740,420 | A | 4/1988 | Akutsu et al. | 428/341 |
| 4,781,985 | A | 11/1988 | Desjariais | 428/421 |
| 4,830,911 | A | 5/1989 | Kojima et al. | 428/342 |
| 4,876,233 | A * | 10/1989 | Saeki et al. | |
| 4,877,680 | A | 10/1989 | Sakaki et al. | 428/332 |
| 4,946,741 | A | 8/1990 | Aono et al. | 428/336 |
| 4,987,049 | A | 1/1991 | Komamura et al. | 430/203 |
| 5,006,407 | A | 4/1991 | Malhotra | 428/336 |
| 5,034,302 | A * | 7/1991 | Adair et al. | |
| 5,073,448 | A | 12/1991 | Vieira et al. | 428/331 |
| 5,212,008 | A | 5/1993 | Malhotra et al. | 428/216 |
| 5,220,346 | A | 6/1993 | Carreira et al. | 346/1.1 |
| 5,223,338 | A | 6/1993 | Malhotra | 428/342 |
| 5,229,246 | A * | 7/1993 | Shibata et al. | 430/217 |
| 5,325,220 | A * | 6/1994 | Saxe | 359/87 |
| 5,376,616 | A * | 12/1994 | Hamano et al. | 503/216 |
| 5,413,629 | A * | 5/1995 | Yasui et al. | 106/21 R |
| 5,563,644 | A * | 10/1996 | Isganitis et al. | 347/100 |

FOREIGN PATENT DOCUMENTS

| | | |
|---|---|---|
| EP | 0439363 | 7/1991 |
| EP | 0557 990 | 2/1993 |
| JP | 61 277484 | 12/1986 |
| JP | 61277484 | 12/1986 |
| ZA | 924610 | 6/1992 |

* cited by examiner

*Primary Examiner*—Pamela R. Schwartz
(74) *Attorney, Agent, or Firm*—Judith L. Byorick

(57) ABSTRACT

Disclosed is a recording sheet which comprises a substrate and an additive material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof.

28 Claims, No Drawings

RECORDING SHEETS CONTAINING PYRROLE, PYRROLIDINE, PYRIDINE, PIPERIDINE, HOMOPIPERIDINE, QUINOLINE, ISOQUINOLINE, QUINUCLIDINE, INDOLE, AND INDAZOLE COMPOUNDS

This is a divisional of application Ser. No. 08/196,676, filed Feb. 15, 1994 now U.S. Pat. No. 6,482,503.

This application is a continuation-in-part of application U.S. Ser. No. 08/033,917, filed Mar. 19, 1993, U.S. Pat. No. 5,441,795, entitled "Recording Sheets Containing Pyridinium Compounds", and application U.S. Ser. No. 08/033,918, filed Mar. 19, 1993, U.S. Pat. No. 5,457,486, entitled "Recording Sheets Containing Tetrazolium, Indolinium, and Imidazolinium Compounds", the disclosures of each of which are totally incorporated herein by reference.

BACKGROUND OF THE INVENTION

The present invention is directed to recording sheets, such as transparency materials, filled plastics, papers, and the like. More specifically, the present invention is directed to recording sheets particularly suitable for use in ink jet printing processes. One embodiment of the present invention is directed to a recording sheet which comprises a substrate and a material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof. Another embodiment of the present invention is directed to a recording sheet which consists essentially of a substrate, at least one material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof, an optional binder, an optional antistatic agent, an optional biocide, and an optional filler.

Recording sheets suitable for use in ink jet printing are known. For example, U.S. Pat. No. 4,740,420 (Akutsu et al.) discloses a recording medium for ink jet printing comprising a support material containing at least in the surface portion thereof a water soluble metal salt with the ion valence of the metal thereof being 2 to 4 and a cationic organic material. The cationic organic materials include salts of alkylamines, quaternary ammonium salts, polyamines, and basic latexes.

U.S. Pat. No. 4,576,867 (Miyamoto) discloses an ink jet recording paper with improved water resistance and sunlight fastness of the image formed on the paper wherein the recording paper has attached to its surface a cationic resin of the formula

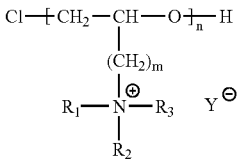

wherein $R_1$, $R_2$, and $R_3$ represent alkyl groups, m represents a number of 1 to 7, and n represents a number of 2 to 20, and Y represents an acid residue.

U.S. Pat. No. 4,446,174 (Maekawa et al.) discloses an ink jet recording method for producing a recorded image on an image receiving sheet with a jet of aqueous ink, wherein an ink jet is projected onto an image receiving sheet comprising a surface layer containing a pigment, and wherein the surface layer is capable of adsorbing a coloring component in the aqueous ink. Poly (vinyl benzyl trimethyl ammonium chloride), poly (diallyl dimethyl ammonium chloride), and poly (methacryloxyethyl-β-hydroxyethyl dimethyl ammonium chloride) are disclosed as dye absorbing adhesive materials.

U.S. Pat. No. 4,830,911 (Kojima et al.) discloses a recording sheet for ink jet printers which gives an image by the use of an aqueous ink containing a water-soluble dye, coated or impregnated with either of or a mixture of two kinds of water soluble polymers, one whose polymeric unit is alkylquaternaryammonium (meth)acrylate and the other whose polymer unit is alkylquaternaryammonium (meth)acrylamide, wherein the water soluble polymers contain not less than 50 mol percent of a monomer represented by the formula

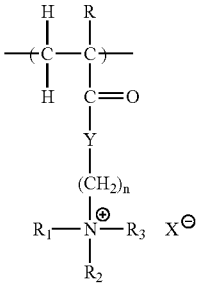

where R represents hydrogen or methyl group, n is an interger from 1 to 3 inclusive, $R_1$, $R_2$, and $R_3$ represent hydrogen or the same or different aliphatic alkyl group with 1 to 4 carbon atoms, X represents an anion such as a halogen ion, sulfate ion, alkyl sulfate ion, alkyl sulfonate ion, aryl sulfonate ion, and acetate ion, and Y represents oxygen or imino group.

U.S. Pat. No. 4,554,181 (Cousin et al.) discloses an ink jet recording sheet having a recording surface which includes a combination of a water soluble polyvalent metal salt and a cationic polymer, the polymer having cationic groups which are available in the recording surface for insolubilizing an anionic dye.

U.S. Pat. No. 4,877,680 (Sakaki et al.) discloses a recording medium comprising a substrate and a nonporous ink receiving layer. The ink receiving layer contains a water-insoluble polymer containing a cationic resin. The recording medium may be employed for recording by attaching droplets of a recording liquid thereon.

European Patent Publication 0 439 363 A1, published Jul. 31, 1991, corresponding to copending application U.S. Ser. No. 07/469,985, U.S. Pat. No. 5,302,249, the disclosure of which is totally incorporated herein by reference, discloses a paper which comprises a supporting substrate with a coating comprising (a) a desizing component selected from the group consisting of (1) hydrophilic poly(dialkylsiloxanes); (2) poly(alkylene glycol); (3) poly(propylene oxide)-poly(ethylene oxide) copolymers; (4) fatty ester modified compounds of phosphate, sorbitan, glycerol, poly(ethylene glycol), sulfosuccinic acid, sulfonic acid and alkyl amine; (5) poly(oxyalkylene) modified compounds of sorbitan esters, fatty amines, alkanol amides, castor oil, fatty acids and fatty alcohols; (6) quaternary alkosulfate compounds; (7) fatty imidazolines; and mixtures thereof, and (b) a hydrophilic binder polymer. The binder polymer may be a quaternary ammonium copolymer such as Mirapol WT, Mirapol AD-1, Mirapol AZ-1, Mirapol A-15, Mirapol-9, Merquat-100, or Merquat-550, available from Miranol Incorporated.

U.S. Pat. No. 5,223,338 (Malhotra), the disclosure of which is totally incorporated herein by reference, discloses a recording sheet which comprises a substrate and a coating consisting essentially of (1) quaternary ammonium polymers selected from the group consisting of (a) polymers of Formula I

I

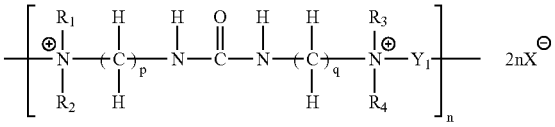

wherein n is an integer of from 1 to about 200, $R_1$, $R_2$, $R_3$, and $R_4$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ is selected from the group consisting of —$CH_2CH_2OCH_2CH_2$—, —$CH_2CH_2OCH_2CH_2OCH_2CH_2$—, —$(CH_2)_k$—, wherein k is an integer of from about 2 to about 10, and —$CH_2CH(OH)CH_2$—; (b) polymers of Formula II

II

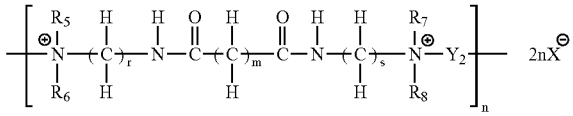

wherein n is an integer of from 1 to about 200, $R_5$, $R_6$, $R_7$, and $R_8$ are each independently selected from the group consisting of alkyl groups, hydroxyalkyl groups, and polyoxyalkylene groups, m is an integer of from 0 to about 40, r is an integer of from 1 to about 10, s is an integer of from 1 to about 10, X is an anion, and $Y_2$ is selected from the group consisting of —$CH_2CH_2OCH_2CH_2$—, —$CH_2CH_2OCH_2CH_2OCH_2CH_2$—, —$(CH_2)_k$—, wherein k is an integer of from about 2 to about 10, and —$CH_2CH(OH)CH_2$—; (c) copolymers of Formula III wherein a and b are each integers wherein the sum of a+b is from about 2 to about 200, $R_1$, $R_2$, $R_3$, $R_4$, $R_5$, $R_6$, $R_7$, and $R_8$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ and $Y_2$ are each independently selected from the group consisting of —$CH_2CH_2OCH_2CH_2$—, —$CH_2CH_2OCH_2CH_2OCH_2CH_2$—, —$(CH_2)_k$—, wherein k is an integer of from about 2 to about 10, and —$CH_2CH(OH)CH_2$—; (d) mixtures of polymers of Formula I and polymers of Formula II; (e) mixtures of polymers of Formula I and copolymers of Formula III; (f) mixtures of polymers of Formula II and copolymers of Formula III; and (g) mixture of polymers of Formula I, polymers of Formula II, and copolymers of Formula III; (2) an optional binder polymer; and (3) an optional filler.

U.S. Pat. No. 5,212,008 (Malhotra et al.), the disclosure of which is totally incorporated herein by reference, discloses a recording sheet which comprises a substrate; a first coating in contact with the substrate which comprises a crosslinking agent selected from the group consisting of hexamethoxymethyl melamine, methylated melamine-formaldehyde, methylated urea-formaldehyde, cationic urea-formaldehyde, cationic polyamine-epichlorohydrin, glyoxal-urea resin, poly (aziridine), poly (acrylamide), poly (N,N-dimethyl acrylamide), acrylamide-acrylic acid copolymer, poly (2-acrylamido-2-methyl propane sulfonic acid), poly (N,N-dimethyl-3,5-dimethylene piperidinium chloride), poly (methylene-guanidine) hydrochloride, poly (ethylene imine) poly (ethylene imine) epichlorohydrin, poly (ethylene imine) ethoxylated, glutaraldehyde, and mixtures thereof; a catalyst; and a polymeric material capable of being crosslinked by the crosslinking agent and selected from the group consisting of polysaccharides having at least one hydroxy group, polysaccharides having at least one carboxy group, polysaccharides having at least one sulfate group, polysaccharides having at least one amine or amino group, polysaccharide gums, poly (alkylene oxides), vinyl polymers, and mixtures thereof; and a second coating in contact with the first coating which comprises a binder and a material selected from the group consisting of fatty imidazolines, ethosulfate quaternary compounds, dialkyl dimethyl methosulfate quaternary compounds, alkoxylated di-fatty quaternary compounds, amine oxides, amine ethoxylates, imidazoline quaternary compounds, alkyl benzyl dimethyl quaternary compounds, poly (epiamines), and mixtures thereof.

U.S. Pat. No. 4,946,741 (Aono et al.) discloses an ink recording sheet comprising a transparent support having thereon an ink recording layer comprising a mixture of an amino group deactivated gelatin derivative and a polyalkylene oxide.

U.S. Pat. No. 4,781,985 (Desjarlais) discloses an ink jet transparency which comprises a substantially transparent

III

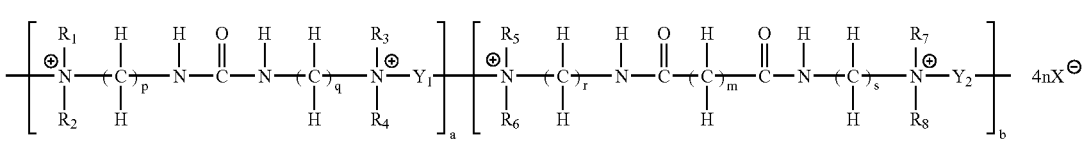

resinous support and a substantially clear coating thereon which includes a specific fluorosurfactant.

U.S. Pat. No. 5,073,448 (Vieira et al.) discloses a recording material for ink jet printing comprising a carrier having a surface which can be printed on or a carrier coated on one side with a material which can be printed on, wherein the carrier or the coting contains as a stabilizer at least one compound of the formula

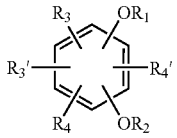

in which $R_1$ and $R_2$ independently of one another are $C_1$–$C_4$ alkyl which is unsubstituted or substituted by one or two —OH, —$COO^-M^+$ and/or —$SO_3^-M^+$ groups, $C_3$–$C_5$ alkenyl, $C_3$–$C_5$ alkynyl,

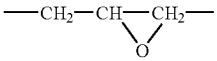

—$CH_2CH(OH)CH_2$—$SO_3^-M^+$, —CO-alkyl($C_1$–$C_4$) which is unsubstituted or substituted by —$COOR^o$ or —CO—N($R_5$)($R_6$) or, if $OR_1$ and $OR_2$ are in the ortho position relative to one another, $R_1$ and $R_2$ together are $C_1$–$C_6$ alkylene, $M^+$ being $H^+$, a monovalent, divalent or trivalent metal cation or a group ($R_{12}$')$N^+$($R_{12}$")($R_{13}$')($R_{14}$'), wherein $R_{12}$', $R_{12}$", $R_{13}$ and $R_{14}$ independently of one another are H, $C_1$–$C_4$ alkyl which is unsubstituted or substituted by 1 or 3 OH, $C_1$–$C_4$ alkyl interrupted by O, allyl, cyclopentyl, cyclohexyl, phenyl, benzyl or tolyl, or $R_1$ is a group

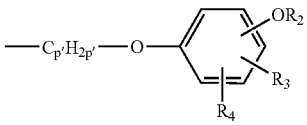

in which p' is a number from 2 to 6, $R_5$ and $R_6$ independently of one another are H or $C_1$–$C_4$ alkyl which is unsubstituted or substituted by an OH, $COOR^o$, —$COO^-M^+$, $SO_3^-M^+$, $P(O)(O\text{-}M^+)_2$ or $P(O)(OR^o)_2$ group, $R_3$' and $R_4$' independently of one another are H, $C_1$–$C_4$ alkyl, OH or $C_1$–$C_4$ alkoxy, $R_3$ and $R_4$ independently of one another are H, halogen, —$OR_7$, —$COOR^o$, —$COO^-M^+$, —OOC—$R_5$, —CO—N($R_5$)($R_6$), —($R_5$)N—CO—$R_6$, —CO—$R_5$, —$SO_3^-M^+$, —$SO_2N(R_5)(R_6)$, $P(OR_5)_3$, —(O)P—$(O^-M^+)_2$, —(O)P—$(OR^o)_2$, $C_1$–$C_8$ alkyl which is unsubstituted or substituted by 1 to 7 —$OR_5$ or —OO—C—$R_5$ groups, by 1 or 2 —$COOR^o$, —$COO^-M^+$, or —CO—N($R_5$)($R_6$) groups or by one or two —$SO_3^-M^+$, —$SO_2N(R_5)(R_6)$ or —(O)P—$(OR_o)_2$ or —$(O)P(O^-M^+)_2$ groups, where $M^+$, $R_5$ and $R_6$ are as defined above, or $C_5$–$C_6$ cycloalkyl or allyl, $R^o$ being $C_1$–$C_4$ alkyl which is unsubstituted or substituted by an —OH group or —$(CH_2CH_2O)_r$—H in which r is 1 to 12, and $R_7$ being $C_1$–$C_4$ alkyl or —CO-alkyl($C_1$–$C_4$) each of which is unsubstituted or substituted by 1 or 2 —OH groups or $R_3$ and $R_4$ independently of one another are one of the groups

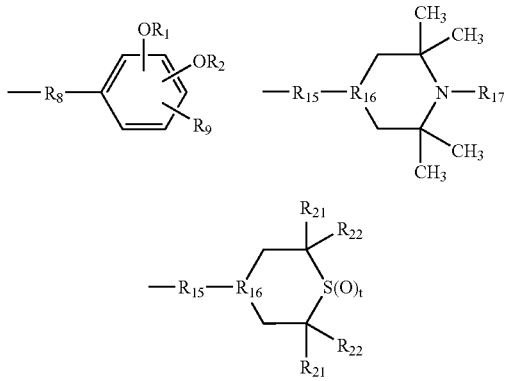

in which $R_8$ is a direct bond or methylene, $R_9$ is H, $C_1$–$C_8$ alkyl, —$COO^-M^+$ or —$SO_3^-M^+$, where $M^+$, $R_1$ and $R_2$ are as defined above, $R_{15}$ is —CO—, —$(O)_g$—$C_pH_{2p}$—CO—, —OOC—$C_pH_{2p}$—, —COO—$C_pH_{2p}$—, —O—$CH_2CH(OH)$—$CH_2$— or

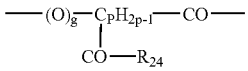

in which g is 0 or 1 and p is 1 to 6 and $R_{24}$ is —$OR_5$, —N($R_5$)($R_6$) or a group

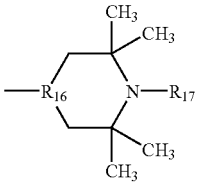

and $R_{16}$ is one of the following radicals:

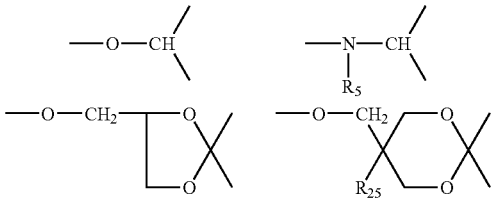

in which $R_{25}$ is H or $C_1$–$C_4$ alkyl, $R_{17}$ is H, $C_1$–$C_4$ alkyl which is unsubstituted or substituted by an —OH group, —$CH_2$—CH(OH)—$CH_2$—OH, $C_1$–$C_4$ alkoxy, —OH, —CO-alkyl($C_1$–$C_4$), —COCH═$CH_2$, allyl, benzyl or a group

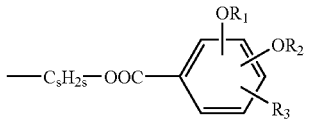

in which s is the number 2 or 3, t is a number from 0 to 2 and $R_{21}$ and $R_{22}$ independently of one another are H, $C_1$–$C_4$ alkyl or phenyl.

South African Patent Application 924,610 discloses a transparent recording sheet suitable for making visual transparencies which comprises a thin transparent film backing bearing on at least one major surface thereof an ink jet receptive layer comprising from 1% to 10% of at least one acid having a pKa of from 2 to 6, said acid being selected from the group consisting of aryl monocarboxylic acids, aryloxy monocarboxylic acids, alkyl carboxylic acids having alkyl groups containing at least 11 carbon atoms, dicarboxylic acids, tricarboxylic acids, and pyridinium salts, and at least one liquid-absorbent polymer comprising from 90% to 99% aprotic constituents, wherein said sheet shows reduced fading when imaged with an ink containing triarylmethane dye and at least one nucleophile over an identical composition containing no protic organic-solvent-soluble additive.

U.S. Pat. No. 5,220,346 (Carreira et al.), the disclosure of which is totally incorporated herein by reference, discloses a printing process which comprises applying in imagewise fashion to a substrate an ink composition which comprises an aqueous liquid vehicle, a colorant, and an ionic compound at least partially ionizable in the liquid vehicle, said ink composition having a conductivity of at least about 10 milliSiemens per centimeter, and subsequently exposing the substrate to microwave radiation, thereby drying the images on the substrate. A specific embodiment of the invention is directed to a thermal ink jet printing process which comprises (1) incorporating into a thermal ink jet printing apparatus an ink composition which comprises an aqueous liquid vehicle, a colorant, and an ionic compound at least partially ionizable in the liquid vehicle, said ink composition having a conductivity of at least about 10 milliSiemens per centimeter; (2) heating the ink in an imagewise pattern to cause bubbles to form therein, thereby causing droplets of the ink to be ejected in an imagewise pattern onto a substrate, thereby generating images on the substrate; and (3) exposing the substrate to microwave radiation, thereby drying the images on the substrate.

Copending application U.S. Ser. No. 08/034,917, U.S. Pat. No. 5,760,809, with the named inventors Shadi L. Malhotra, Brent S. Bryant, and Doris K. Weiss, filed Mar. 19, 1993, entitled "Recording Sheets Containing Phosphonium Compounds," the disclosure of which is totally incorporated herein by reference, discloses a recording sheet which comprises a base sheet, a phosphonium compound, an optional pigment, and an optional binder. In a preferred embodiment, the phosphonium compound is selected from the group consisting of

I

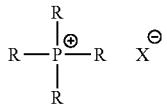

wherein R is an alkyl group, X is an anion, and all four R groups are the same;

II

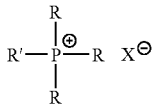

wherein R is an alkyl group, wherein all three R groups are the same, wherein R is not the same as R', X is an anion, and R' is selected from the group consisting of alkyl groups, substituted alkyl groups, arylalkyl groups, and substituted arylalkyl groups;

III

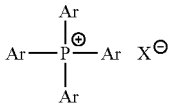

wherein Ar is an aryl group or a substituted aryl group, X is an anion, and all four Ar groups are the same;

IV

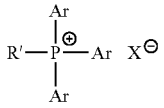

wherein Ar is an aryl group or a substituted aryl group, wherein all three Ar groups are the same, X is an anion, and R' is selected from the group consisting of alkyl groups, substituted alkyl groups, arylalkyl groups, and substituted arylalkyl groups; and mixtures thereof.

Copending application U.S. Ser. No. 08/034,943, U.S. Pat. No. 5,314,747, with the named inventors Shadi L. Malhotra and Brent S. Bryant, filed Mar. 19, 1993, entitled "Recording Sheets Containing Cationic Sulfur Compounds," the disclosure of which is totally incorporated herein by reference, discloses a recording sheet which comprises (a) a base sheet; (b) a cationic sulfur compound selected from the group consisting of sulfonium compounds, thiazolium compounds, benzothiazolium compounds, and mixtures thereof; (c) an optional binder; and (d) an optional pigment.

Copending application U.S. Ser. No. 08/033,917, U.S. Pat. No. 5,441,795, with the named inventors Shadi L. Malhotra and Brent S. Bryant, filed Mar. 19, 1993, entitled "Recording Sheets Containing Pyridinium Compounds," the disclosure of which is totally incorporated herein by reference, discloses a recording sheet which comprises a base sheet and a material selected from the group consisting of pyridinium compounds, piperazinium compounds, and mixtures thereof.

Copending application U.S. Ser. No. 08/034,445, U.S. Pat. No. 5,320,902, with the named inventors Shadi L. Malhotra, Brent S. Bryant, and Doris K. Weiss, filed Mar. 19, 1993, entitled "Recording Sheets Containing Monoammonium Compounds," the disclosure of which is totally incorporated herein by reference, discloses a recording sheet which consists essentially of a substrate and, in contact with the substrate, a monoammonium compound of the formula:

I

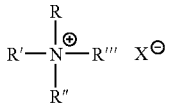

wherein R is an alkyl group, X is selected from the group consisting of fluoride, chloride, bromide, iodide, and astatide, and R', R", and R"' are each independently selected from the group consisting of alkyl groups, substituted alkyl groups, aryl groups, substituted aryl groups, arylalkyl groups, and substituted arylalkyl groups, wherein R, R', R" and R"' are either the same as or different from each other; and mixtures thereof; an optional binder component; and an optional filler component.

Copending application U.S. Ser. No. 08/033,918 U.S. Pat. No. 5,457,486, with the named inventors Shadi L. Malhotra, Brent S. Bryant, and Doris K. Weiss, filed Mar. 19, 1993, entitled "Recording Sheets Containing Tetrazolium, Indolinium, and Imidazolinium Compounds," the disclosure of which is totally incorporated herein by reference, discloses a recording sheet which comprises (a) a base sheet; (b) a material selected from the group consisting of tetrazolium compounds, indolinium compounds, imidazolinium compounds, and mixtures thereof; (c) an optional pigment; and (d) an optional binder.

Copending application U.S. Ser. No. 08/196,669, U.S. Pat. No. 5,500,668, with the named inventors Shadi L. Malhotra, Kurt B. Gundlach, and Richard L. Colt, filed concurrently herewith, entitled "Recording Sheets for Printing Processes Using Microwave Drying," the disclosure of which is totally incorporated herein by reference, discloses a printing process which comprises (a) providing a recording sheet which comprises a substrate, at least one monomeric salt, an optional binder, an optional antistatic agent, an optional biocide, and an optional filler; (b) applying an aqueous recording liquid to the recording sheet in an imagewise pattern; and (c) thereafter exposing the substrate to microwave radiation, thereby drying the recording liquid on the recording sheet.

Copending application U.S. Ser. No. 08/196,922, with the named inventor Shadi L. Malhotra, filed concurrently herewith, entitled "Recording Sheets Containing Alcohols and Saccharides," the disclosure of which is totally incorporated herein by reference, discloses a recording sheet which comprises a substrate and a material selected from the group consisting of monosaccharides, oligosaccharides, and mixtures thereof. Another embodiment of the present invention is directed to a printing process which comprises (a) providing a recording sheet which comprises a substrate, a material selected from the group consisting of monomeric alcohols, monosaccharides, oligosaccharides, and mixtures thereof, an optional binder, an optional antistatic agent, an optional biocide, and an optional filler; (b) applying an aqueous recording liquid to the recording sheet in an imagewise pattern; and (c) thereafter exposing the substrate to microwave radiation, thereby drying the recording liquid on the recording sheet.

Copending application U.S. Ser. No. 08/196,679, U.S. Pat. No. 5,589,277, with the named inventor Shadi L. Malhotra, filed concurrently herewith, entitled "Recording Sheets Containing Amino Acids, Hydroxy Acids, and Polycarboxyl Compounds," the disclosure of which is totally incorporated herein by reference, discloses a recording sheet which comprises a paper substrate and a material selected from the group consisting of monomeric amino acids, monomeric hydroxy acids, monomeric polycarboxyl compounds, and mixtures thereof. Another embodiment of the present invention is directed to a recording sheet which comprises a substrate and an additive material selected from the group consisting of monomeric amino acids, monomeric hydroxy acids, and mixtures thereof.

Copending application U.S. Ser. No. 08/196,607, with the named inventor Shadi L. Malhotra, filed concurrently herewith, entitled "Recording Sheets Containing Amine Salts and Quaternary Choline Halides," the disclosure of which is totally incorporated herein by reference, discloses a recording sheet which comprises a substrate and a material selected from the group consisting of monomeric amine acid salts, monomeric quaternary choline halides, and mixtures thereof.

Copending application U.S. Ser. No. 08/196,933, with the named inventor Shadi L. Malhotra, filed concurrently herewith, entitled "Recording Sheets Containing Purine, Pyrimidine, Benzimidazole, Imidazolidine, Urazole, Pyrazole, Triazole, Renzotriazole. Tetrazole; and Pyrazine Compounds," the disclosure of which is totally incorporated herein by reference, discloses a recording sheet which comprises a substrate and a material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof. Also disclosed is a recording sheet which consists essentially of a substrate, at least one material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof, an optional binder, an optional antistatic agent, an optional biocide, and an optional filler.

Copending application U.S. Ser. No. 08/196,672, U.S. Pat. No. 6,180,238, with the named inventor Shadi L. Malhotra, filed concurrently herewith, entitled "Recording Sheets Containing Oxazole, Isooxazole, Oxazolidinone, Oxazoline Salt, Morpholine, Thiazole, Thiazolidine, Thiadiazole, and Phenothiazine Compounds," the disclosure of which is totally incorporated herein by reference, discloses a recording sheet which comprises a substrate and a material selected from the group consisting of oxazole compounds, isooxazole compounds, oxazolidinone compounds, oxazoline salt compounds, morpholine compounds, thiazole compounds, thiazolidine compounds, thiadiazole compounds, phenothiazine compounds, and mixtures thereof. Also disclosed is a recording sheet which consists essentially of a substrate, at least one material selected from the group consisting of oxazole compounds, isooxazole compounds, oxazolidinone compounds, oxazoline salt compounds, morpholine compounds, thiazole compounds, thiazolidine compounds, thiadiazole compounds, phenothiazine compounds, and mixtures thereof, an optional binder, an optional antistatic agent, an optional biocide, and an optional filler.

Copending application U.S. Ser. No. 08/196,605, U.S. Pat. No. 5,663,004, with the named inventors Shadi L. Malhotra, Brent S. Bryant, and Arthur Y. Jones, filed concurrently herewith, entitled "Recording Sheets Containing Mildew Preventing Agents," the disclosure of which is totally incorporated herein by reference, discloses a recording sheet which comprises a substrate, an image receiving coating, and a biocide.

While known compositions and processes are suitable for their intended purposes, a need remains for improved recording sheets In addition, there is a need for improved recording sheets suitable for use in ink jet printing processes. Further, a need remains for recording sheets which exhibit rapid drying times when imaged with aqueous inks Additionally, there is a need for recording sheets which enable precipitation of a dye from a liquid ink onto the sheet surface during printing processes. A need also remains for recording sheets which are particularly suitable for use in printing processes wherein the recorded substrates are imaged with liquid inks and dried by exposure to microwave radiation. Further, there is a need for recording sheets coated with a discontinuous, porous film. There is also a need for recording sheets which, subsequent to being imaged with an aqueous ink, exhibit reduced curling.

SUMMARY OF THE INVENTION

It is an object of the present invention to provide recording sheets with the above noted advantages.

It is another object of the present invention to provide recording sheets suitable for use in ink jet printing processes.

It is yet another object of the present invention to provide recording sheets which exhibit rapid drying times when imaged with aqueous inks.

It is still another object of the present invention to provide recording sheets which enable precipitation of a dye from a liquid ink onto the sheet surface during printing processes.

Another object of the present invention is to provide recording sheets which are particularly suitable for use in printing processes wherein the recorded substrates are imaged with liquid inks and dried by exposure to microwave radiation.

Yet another object of the present invention is to provide recording sheets coated with a discontinuous, porous film.

Still another object of the present invention is to provide recording sheets which, subsequent to being imaged with an aqueous ink, exhibit reduced curling.

These and other objects of the present invention (or specific embodiments thereof) can be achieved by providing a recording sheet which comprises a substrate and a material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof Another embodiment of the present invention is directed to a recording sheet which consists essentially of a substrate, at least one material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof, an optional binder, an optional antistatic agent, an optional biocide, and an optional filler.

DETAILED DESCRIPTION OF THE INVENTION

The recording sheets of the present invention comprise a substrate and at least one material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof. Any suitable substrate can be employed. Examples include transparent materials, such as polyester, including Mylar™, available from E. I. Du Pont de Nemours & Company, Melinex™, available from Imperial Chemicals, Inc., Celanar™, available from Celanese Corporation, polyethylene naphthalates, such as Kaladex PEN Films, available from Imperial Chemicals, Inc., polycarbonates such as Lexan™, available from General Electric Company, polysulfones, such as those available from Union Carbide Corporation, polyether sulfones, such as those prepared from 4,4'-diphenyl ether, such as Udel™, available from Union Carbide Corporation, those prepared from disulfonyl chloride, such as Victrex™, available from ICI America Incorporated, those prepared from biphenylene, such as Astrel™, available from 3M Company, poly (arylene sulfones), such as those prepared from crosslinked poly(arylene ether ketone sulfones), cellulose triacetate, polyvinylchloride cellophane, polyvinyl fluoride, polyimides, and the like, with polyester such as Mylar™ being preferred in view of its availability and relatively low cost. The substrate can also be opaque, including opaque plastics, such as Teslin™, available from PPG Industries, and filled polymers, such as Melinex®, available from ICI. Filled plastics can also be employed as the substrate, particularly when it is desired to make a "never-tear paper" recording sheet. Paper is also suitable, including plain papers such as Xerox® 4024, diazo papers, or the like.

In one embodiment of the present invention, the substrate comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company—Anatase grade AHR), calcium silicate CH-427-97-8, XP-974 (J. M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in ink jet processes. Preferred basis weights for the substrate are from about 40 to about 400 grams per square meter, although the basis weight can be outside of this range.

Illustrative examples of commercially available internally and externally (surface) sized substrates suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox® 4024™ papers and sized calcium silicate-clay filled papers being particularly preferred in view of their availability, reliability, and low print through. Pigmented filled plastics, such as Teslin (available from PPG industries), are also preferred as supporting substrates.

The substrate can be of any effective thickness. Typical thicknesses for the substrate are from about 50 to about 500 microns, and preferably from about 100 to about 125 microns, although the thickness can be outside these ranges.

Situated on the substrate of the present invention is a material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof.

Pyrrole compounds generally are those of the general formula

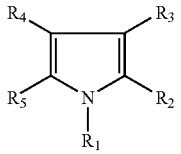

wherein $R_1$, $R_2$, $R_3$, $R_4$, and $R_5$ each, independently of one another, can be (but are not limited to) hydrogen, alkyl, substituted alkyl (such as alkyl carboxyl, alkyl vinyl, alkyl hydroxyl, carbonyl alkyl piperazine, alkyl halide, alkyl pyrrolidinyl, or the like), hydroxyl, carboxyl, amide, oxo, alkoxy, aldehyde, acetyl, carbonyl alkyl piperazine, acetyl, amino, alkylene, ammonium thio carbamate, ester, arylalkyl, substituted arylalkyl (such as benzyl halide or the like), vinyl, or the like. Pyrrolidine compounds generally are those of the general formula

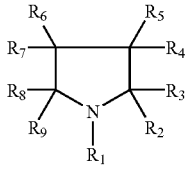

wherein $R_1$, $R_2$, $R_3$, $R_4$, $R_5$, $R_6$, $R_7$, $R_8$, and $R_9$ each, independently of one another, can be (but are not limited to) hydrogen, alkyl, substituted alkyl (such as alkyl carboxyl, alkyl vinyl, alkyl hydroxyl, carbonyl alkyl piperazine, alkyl halide, alkyl pyrrolidinyl, or the like), hydroxyl, carboxyl, amide, oxo, alkoxy, aldehyde, acetyl, carbonyl alkyl piperazine, acetyl, amino, alkylene, ammonium thio carbamate, ester, arylalkyl, substituted arylalkyl (such as benzyl halide or the like), vinyl, or the like. Other variations are also possible, such as a double bond between one of the ring carbon atoms and another atom, such as carbon, oxygen, or the like.

Examples of pyrrole compounds and pyrrolidine compounds include (1) 2-acetyl-pyrrole (Aldrich 24,735-9), of the formula:

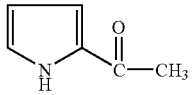

(2) 2-acetyl-1-methylpyrrole (Aldrich 16,086-5), of the formula:

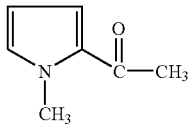

(3) 3-acetyl-1-methylpyrrole (Aldrich 30,986-9), of the formula:

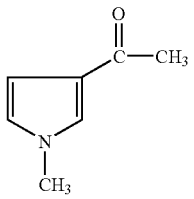

(4) 3-acetyl-2,4-dimethylpyrrole (Aldrich A1,480-4), of the formula:

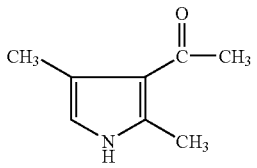

(5) pyrrole-2-carboxaldehyde (Aldrich P7,340-4), of the formula:

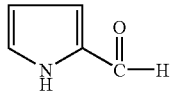

(6) pyrrole-2-carboxylic acid (Aldrich P7,360-9), of the formula:

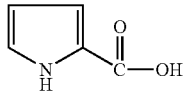

(7) 3-carboxy-1,4-dimethyl-2-pyrroleacetic acid (Aldrich 31,625-3), of the formula:

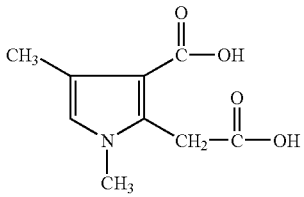

(8) L-proline amide (Aldrich 28,705-9), of the formula:

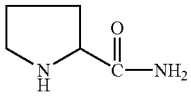

(9) proline (Aldrich 13,154-7; 17,182-4; 85,891-9), of the formula:

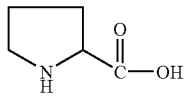

(10) 1-(pyrrolidino carbonylmethyl) piperazine (Aldrich 19,783-1), of the formula:

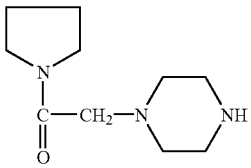

(11) 2-pyrrolidone-5-carboxylic acid (Aldrich P7,520; 29,291-5), of the formula:

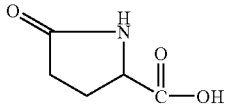

(12) 3-pyrrolidone-1,2-propane diol (Aldrich 21,851-0), of the formula:

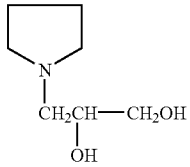

(13) 4-hydroxy-L-proline (Aldrich H5,440-9; 21,994-0; 21,995-9), of the formula:

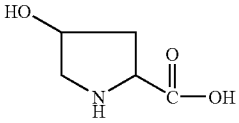

(14) 1,1'-ethylene bis(5-oxo-3-pyrrolidine carboxylic acid) (Aldrich 32,756-5), of the formula:

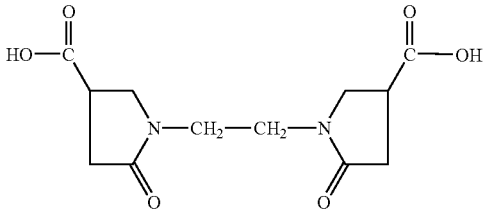

(15) kainic acid monohydrate (2-carboxy-4-isopropenyl-3-pyrrolidine acetic acid monohydrate) (Aldrich 28,634-6), of the formula:

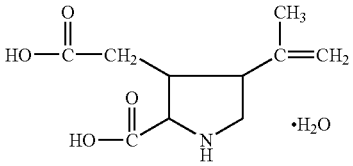

and the like.

The general groups of pyrrole and pyrrolidine compounds encompass pyrrole and pyrrolidine acid salt compounds, which are of the same general formulae as pyrrole and pyrrolidine compounds except that they are associated with a compound of the general formula $xH_nY^{n-}$, wherein n is an integer of 1, 2, or 3, x is a number indicating the relative ratio between pyrrole or pyrrolidine and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof.

Examples of pyrrolidine acid salt compounds include (1) 1-amino pyrrolidine hydrochloride (Aldrich 12,310-2), of the formula:

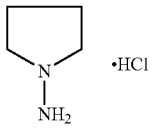

(2) 2-(2-chloroethyl)-1-methyl pyrrolidine hydrochloride (Aldrich 13,952-1), of the formula:

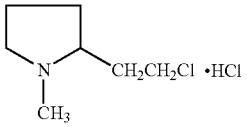

(3) 1-(2-chloroethyl) pyrrolidine hydrochloride (Aldrich C4,280-7), of the formula:

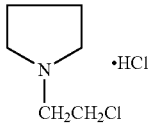

(4) L-proline methyl ester hydrochloride (Aldrich 28,706-7), of the formula:

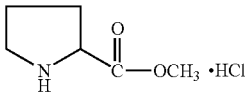

(5) tremorine dihydrochloride [1,1'-(2-butynylene) dipyrrolidine hydrochloride] (Aldrich T4,365-6), of the formula:

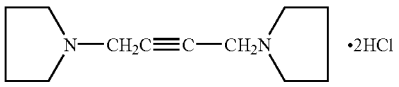

(6) ammonium pyrrolidine dithiocarbamate (Aldrich 14,269-7), of the formula:

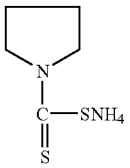

(7) pyrrolidone hydrotribromide (Aldrich 15,520-9), of the formula:

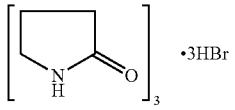

(8) 1-(4-chlorobenzyl)-2-(1-pyrrolidinyl methyl) benzimidazole hydrochloride (Aldrich 34,208-4), of the formula:

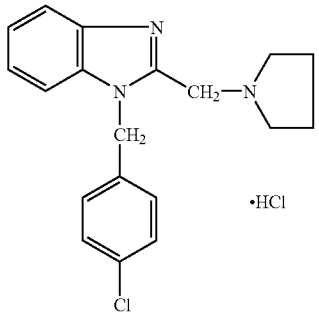

(9) billverdin dihydrochloride (Aldrich 25,824-5), of the formula:

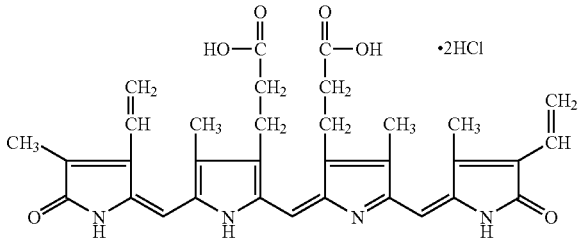

and the like.

Pyridine compounds are those of the general formula

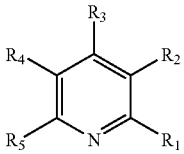

wherein $R_1$, $R_2$, $R_3$, $R_4$, and $R_5$ each, independently from one another, can be (but are not limited to) hydrogen, alkyl, substituted alkyl (such as hydroxy alkyl, alkyl sulfonic acid, hydroxy alkyl sulfonic acid, hydroxy alkyl amide, alkyl halide, alkyl imine, alkyl carboxyl, alkyl amine, alkyl imine amide, alkyl phosphate, or the like), carboxyl, amide, carboxyl anhydride, carboxyimide, sulfonic acid, acrylic acid, alkylene, arylalkyl, substituted arylalkyl (such as aryl alkyl amine and the like), hydrazine, hydroxyl, aldehyde, alkoxy, or the like. Other variations are also possible, such as where 2 or more substituents join to form another ring, or the like.

Examples of pyridine compounds include (1) 2,3-pyridine dicarboxylic acid (Aldrich P6,320-4), of the formula:

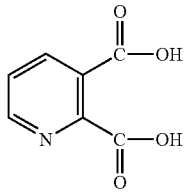

(2) 2,4-pyridine dicarboxylic acid monohydrate (Aldrich P6,339-5), of the formula:

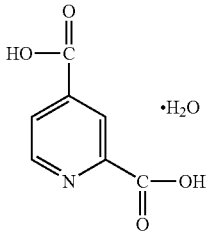

(3) 2,5-pyridine dicarboxylic acid (Aldrich P6,360-3), of the formula:

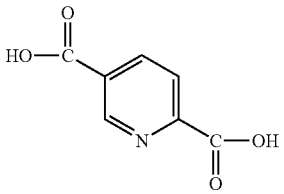

(4) 2,6-pyridine dicarboxylic acid (Aldrich P6,380-8), of the formula:

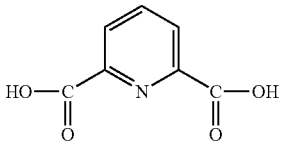

(5) 3,4-pyridine dicarboxylic acid (Aldrich P6,400-6), of the formula.

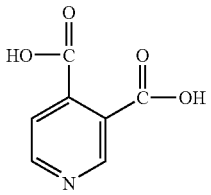

(6) 3,5-pyridene dicarboxylic acid (Aldrich P6,420-0), of the formula:

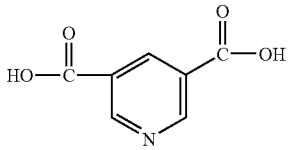

(7) 2,6-pyridene dicarboxaldehyde (Aldrich 25,600-5), of the formula:

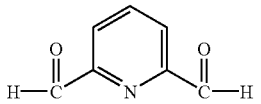

(8) 3,4-pyridene carboxamide (Aldrich 32,856-1), of the formula:

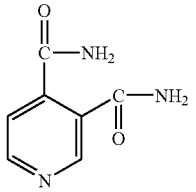

(9) 3,4-pyridine carboximide (Aldrich 32,858-8), of the formula:

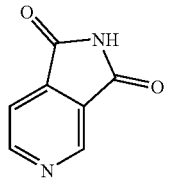

(10) 2,3-pyridine carboxylic anhydride (Aldrich P6,440-5), of the formula:

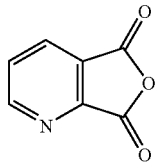

(11) 3,4-pyridine carboxylic anhydride (Aldrich 28,271-5), of the formula:

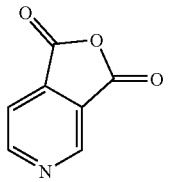

(12) 2,6-pyridine methanol (Aldrich 15,436-9), of the formula:

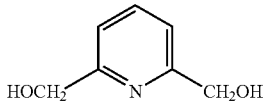

(13) 2-pyridine ethane sulfonic acid (Aldrich 30,392-5), of the formula

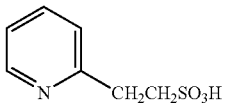

(14) 4-pyridine ethane sulfonic acid (Aldrich 14,242-5), of the formula:

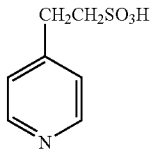

(15) 3-pyridine sulfonic acid (Aldrich P6,480-4), of the formula:

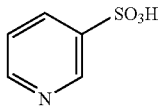

(16) pyridoxic acid (Aldrich 28,710-5), of the formula:

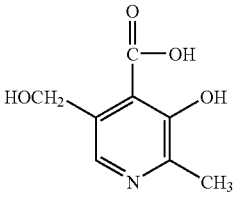

(17) trans-3-(3-pyridyl) acrylic acid (Aldrich P6,620-3), of the formula

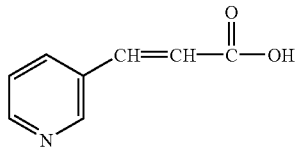

(18) 2-pyridyl hydroxymethane sulfonic acid (Aldrich 85,616-9), of the formula:

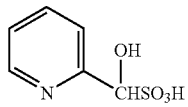

(19) 3-pyridyl hydroxymethane sulfonic acid (Aldrich P6,840-0), of the formula:

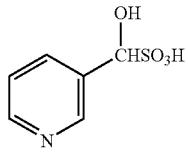

(20) 6-methyl-2,3-pyridine dicarboxylic acid (Aldrich 34,418-4), of the formula:

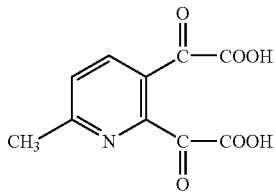

(21) isonicotinic acid (Aldrich I-1,750-8), of the formula:

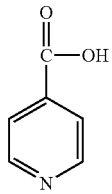

(22) N,N-bis(2-hydroxyethyl) isonicotinic (Aldrich 34,481-8), of the formula:

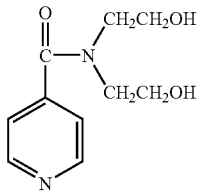

(23) 4,4'-trimethylene pyridine (Aldrich 12,119-3), of the formula:

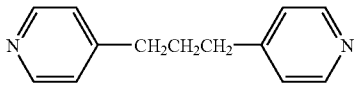

(24) 2-(2-piperidinoethyl) pyridine (Aldrich 30,396-8), of the formula:

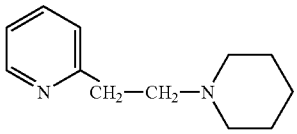

and the like.

The general group of pyridine compounds encompasses pyridine acid salt compounds, which are of the same general formula as pyridine compounds except that they are associated with a compound of the general formula $xH_nY^{n-}$, wherein n is an integer of 1, 2, or 3, x is a number indicating the relative ratio between pyrrole or pyrrolidine and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof.

Examples of suitable pyridine acid salts include (1) pyridine hydrobromide (Aldrich 30,747-5), of the formula:

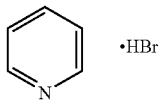

(2) pyridine hydrochloride (Aldrich 24,308-6), of the formula:

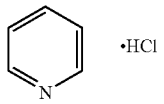

(3) 2-(chloromethyl) pyridine hydrochloride (Aldrich 16,270-1), of the formula:

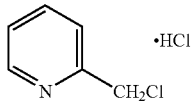

(4) 2-pyridylacetic acid hydrochloride (Aldrich P6,560-6), of the formula:

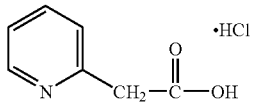

(5) nicotinoyl chloride hydrochloride (Aldrich 21,338-1), of the formula:

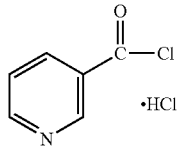

(6) 2-hydrazinopyridine dihydrochloride (Aldrich H1,710-4), of the formula:

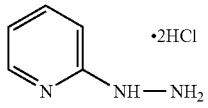

(7) 2-(2-methyl aminoethyl) pyridine dihydrochloride (Aldrich 15,517-9), of the formula:

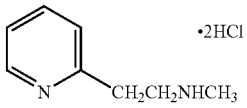

(8) 1-methyl-1,2,3,6-tetrahydropyridine hydrochloride (Aldrich 33,238-0), of the formula:

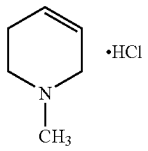

(9) 2,6-dihydroxypyridine hydrochloride (Aldrich D12,000-6), of the formula:

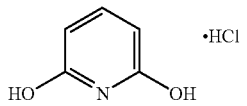

(10) 3-hydroxy-2(hydroxymethyl) pyridine hydrochloride (Aldrich H3,153-0), of the formula:

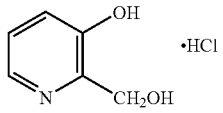

(11) pyridoxine hydrochloride (Aldrich 11,280-1), of the formula:

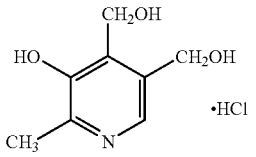

(12) pyridoxal hydrochloride (Aldrich 27,174-8), of the formula:

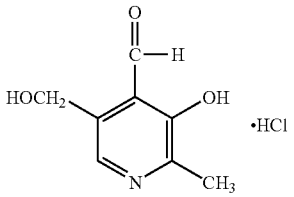

(13) pyridoxal 5-phosphate monohydrate (Aldrich 85,786-6), of the formula:

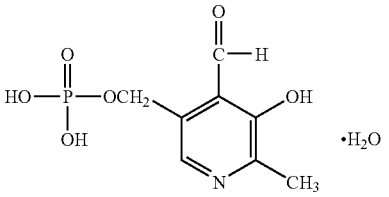

(14) 3-amino-2,6-dimethoxy pyridine hydrochloride (Aldrich 14,325-1), of the formula:

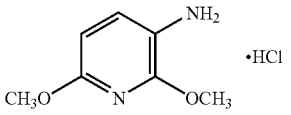

(15) pyridoxamine dihydrochloride monohydrate (Aldrich 28,709-1), of the formula:

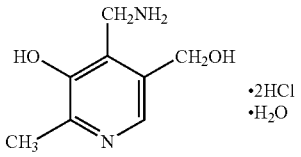

16) iproniazid phosphate (isonicotinic acid 2-isopropyl hydrazide phosphate) (Aldrich I-1,265-4), of the formula:

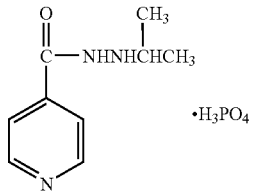

(17) tripelennamine hydrochloride (Aldrich 28,738-5), of the formula:

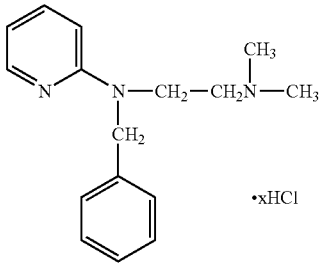

and the like.

Piperidine compounds are those of the general formula

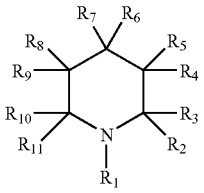

wherein $R_1$, $R_2$, $R_3$, $R_4$, $R_5$, and $R_6$ each, independently of one another, can be (but are not limited to) hydrogen, alkyl, substituted alkyl (such as hydroxyalkyl, carboxy alkyl, alkyl nitrile, alkyl imino, and the like), aryl (such as phenyl and the like), substituted aryl, arylalkyl, substituted arylalkyl (such as alkyl phenol and the like), amide, carboxyl, oxo, alkylene, alkoxy, aryloxy, halogenated phenoxy acetate, phosphate, another piperidine moiety, or the like. Other variations are also possible, such as a double bond between one of the ring carbon atoms and another atom, such as carbon, oxygen, or the like.

Examples of suitable piperidine compounds include (1) 2-piperidine methanol (Aldrich 15,522-5), of the formula:

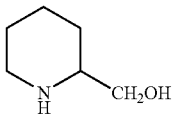

(2) 3-piperidine methanol (Aldrich 15,523-3), of the formula:

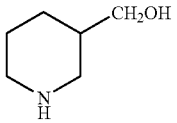

(3) 2-piperidine ethanol (Aldrich 13,152-0), of the formula:

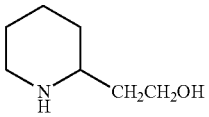

(4) 4-piperidine ethanol (Aldrich P4,615-6), of the formula:

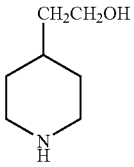

(5) 3-piperidino-1,2-propane diol (Aldrich 21,849-9), of the formula:

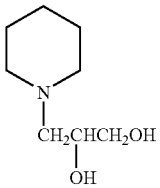

(6) 1-piperidine propionic acid (Aldrich 33,592-4), of the formula:

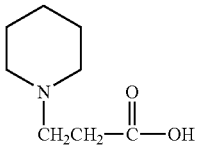

(7) 2-piperidine carboxylic acid (Alrich 23,775-2, P4,585-0; 26,806-2), of the formula:

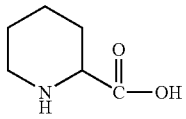

(8) 4-piperidinopiperidine (Aldrich 15,005-3), of the formula:

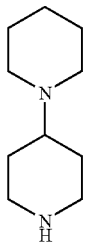

(9) 4-phenyl piperidine (Aldrich 14,826-1), of the formula:

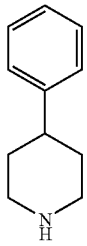

(10) 2,2,6,6-tetramethyl piperidine (Aldrich 11,574-4), of the formula:

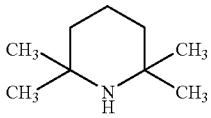

(11) 2-piperidone (Aldrich V,20-9), of the formula:

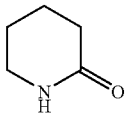

(12) 1-methyl-4 (methylamino) piperidine (Aldrich 22,140-6), of the formula:

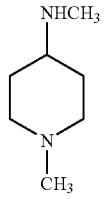

(13) 4,4'-trimethylene bis(1-methyl piperidine) (Aldrich 19,226-0), of the formula:

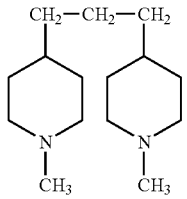

(14)4,4'-trimethylene dipiperidine (Aldrich 12,120-7), of the formula:

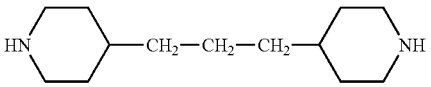

(15) tris piperidinophosphine oxide (Aldrich 21,625-9), of the formula:

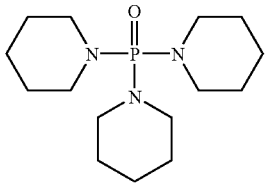

(16) 4,4'-trimethylene bis(1-piperidine carboxamide) (Aldrich 34,478-8), of the formula:

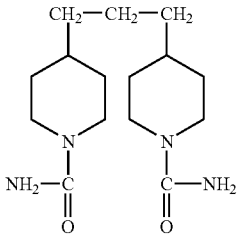

(17) 4,4'-trimethylene bis(1-piperidine propionitrile) (Aldrich 34,479-6), of the formula:

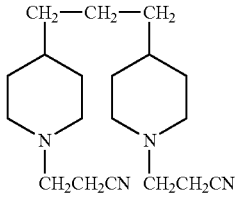

(18) 4-methyl-2-(piperidinomethyl) phenol (Aldrich 34,489-3), of the formula:

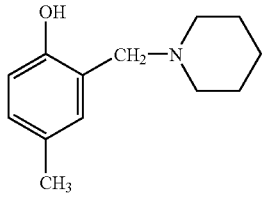

(19) 1-methyl-4-piperidinyl bis(chlorophenoxy) acetate (Aldrich 21,419-1), of the formula:

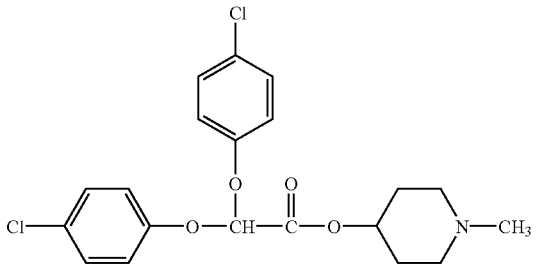

and the like.

Homopiperidine compounds are those of the general formulae

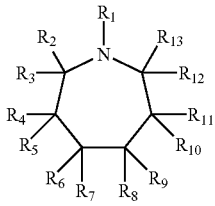

and

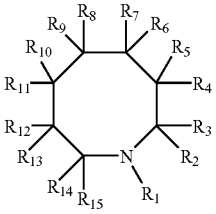

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, and $R_{15}$ each independently of one another, can be (but are not limited to) hydrogen, alkyl, substituted alkyl (such as alkyl imine, alkyl halide, or the like), aryl (such as phenyl or the like), substituted aryl (such as nitropropiophenone or the like), amide, or the like. Other variations are also possible, such as a double bond between one of the ring carbon atoms and another atom, such as carbon, oxygen, or the like, or wherein two or more substituents are joined together to form another ring, or the like. Homopiperidines can also be in acid salt form, wherein they are associated with a compound of the general formula $xH_nY^{n-}$, wherein n is an integer of 1, 2, or 3, x is a number indicating the relative ratio between pyrrole or pyrrolidine and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof.

Examples of homopiperidine compounds include (1) 2-(hexamethylene imino) ethyl chloride monohydrochloride (Aldrich H1,065-7), of the formula:

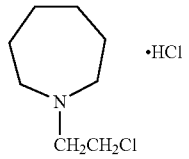

(2) 3-(hexahydro-1H-azepin-1-yl)-3'-nitropropiophenone hydrochloride (Aldrich 15,912-3), of the formula:

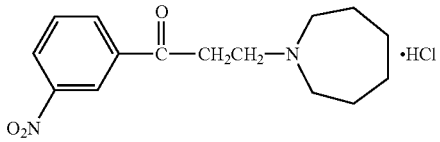

(3) imipramine hydrochloride [5-(3-dimethyl aminopropyl)-10,11-dihydro 5H-dibenz-(b,f) azepine hydrochloride] (Aldrich 28,626-5), of the formula:

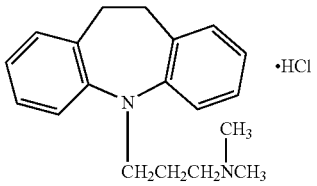

(4) carbamezepine [5H-dibenzo (b,f)-azepine-5-carboxamide] (Adlrich 30,948-6), of the formula:

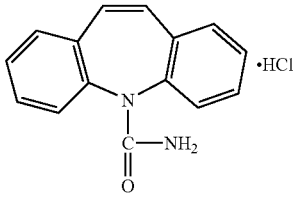

(5) 5,6,11,12-tetrahydro dibenz [b,f] azocine hydrochloride (Aldrich 18,761-5), of the formula:

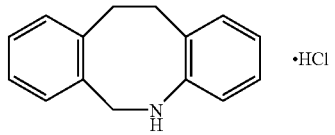

and the like.

Quinoline compounds are of the general formula

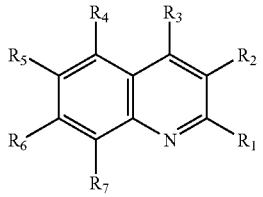

wherein $R_1$, $R_2$, $R_3$, $R_4$, $R_5$, $R_6$, and $R_7$ each, independently of one another, can be (but are not limited to) hydrogen, alkyl, substituted alkyl (such as alkyl amide, alkyl halide, alkyl carboxyl, alkyl amino, amido alkyl amine, or the like), aryl (such as phenyl or the like), substituted aryl, hydroxyl, amino, aldehyde, carboxyl, mercapto, alkoxy, amide, or the like. Other variations are also possible, such as wherein one or two of the double bonds in one of the rings is hydrogenated, or wherein two or more substituents are joined together to form a ring, or the like.

Examples of suitable quinoline compounds include (1) quinoline (Aldrich Q125-5), of the formula:

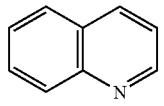

(2) 2-hydroxyquinoline (Aid rich 27,087-3), of the formula:

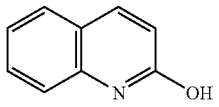

(3) 4-hydroxy quinoline (Aldrich H5,800-5), of the formula:

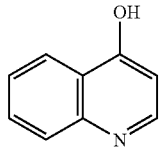

(4) 5-hydroxy quinoline (Aldrich 12,879-1), of the formula:

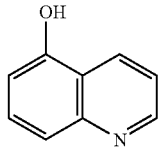

(5) 8-hydroxy quinoline (Aldrich H5,830-7), of the formula:

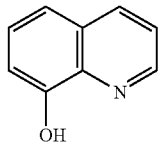

(6) 3-amino quinoline (Aldrich 23,228-9), of the formula:

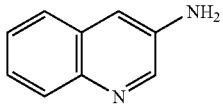

(7) 5-amino quinoline (Aldrich A7,920-5), of the formula:

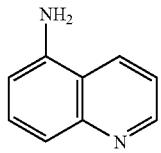

(8) 6-amino quinoline (Aldrich 27,558-1), of the formula:

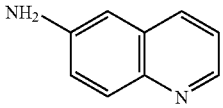

(9) 8-aminoquinoline (Aldrich 26,078-9), of the formula:

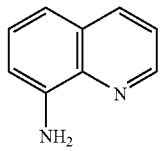

(10) 2-quinoline carboxylic acid (Aldrich 16,066-0), of the formula:

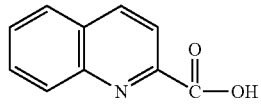

(11) 3-quinoline carboxylic acid (Aldrich 17,714-8), of the formula:

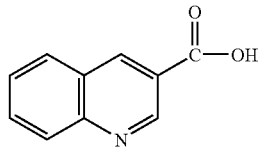

(12) 4-quinoline carboxylic acid (Aldrich 17,482-3), of the formula:

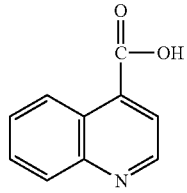

(13) 4-quinoline carboxaldehyde (Aldrich 17,696-6), of the formula:

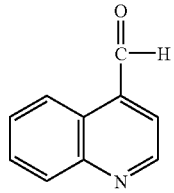

(14) 2-quinoline thiol (Aldrich 11,627-0), of the formula:

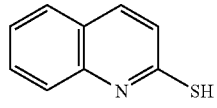

(15) 2,4-quinoline diol (Aldrich Q133-6), of the formula:

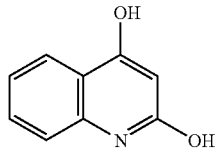

(16) quinaldine (Aldrich 12,332-3), of the formula:

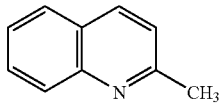

(17) 8-hydroxyquinaldine (Aldrich H5,760-2), of the formula:

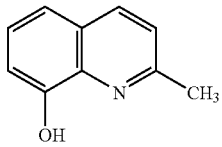

(18) 4-aminoquinaldine (Aldrich A7,900-0), of the formula:

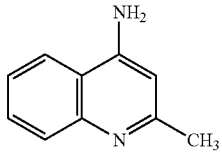

(19) 2,6-dimethyl quinoline (Aldrich 14,402-9), of the formula:

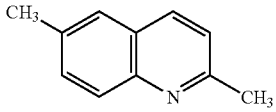

(20) 2,7-dimethyl quinoline (Aldrich 14,564-5), of the formula:

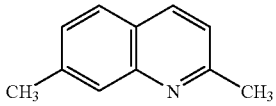

(21) 4-methoxy-2-quinoline carboxylic acid (Aldrich 30,508-1), of the formula:

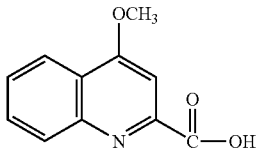

(22) 7,8-benzoquinoline (Aldrich 12,361-7), of the formula:

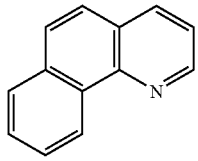

(23) methyl-2-phenyl-4-quinoline carboxylate (Aldrich 15,367-2), of the formula:

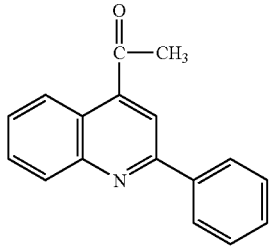

(24) 1,2,3,4-tetrahydro quinoline (Aldrich T1,550-4), of the formula:

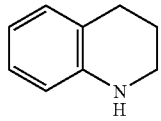

(25) 6-ethoxy-1,2,3,4-tetrahydro-2,2,4-trimethyl quinoline (Aldrich 19,636-3), of the formula:

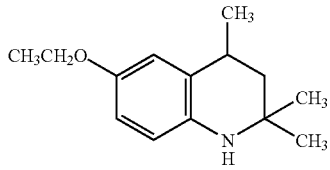

and the like.

Isoquinoline compounds are those of the general formula

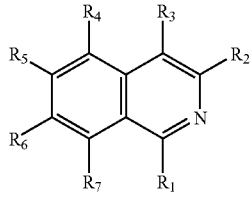

wherein $R_1$, $R_2$, $R_3$, $R_4$, $R_5$, $R_6$, and $R_7$ each, independently of one another, can be (but are not limited to) hydrogen, alkyl, substituted alkyl (such as alkyl amide, alkyl halide, alkyl carboxyl, alkyl amino, amido alkyl amine, or the like), aryl (such as phenyl or the like), substituted aryl, hydroxyl, amino, aldehyde, carboxyl, mercapto, alkoxy, amide, or the like. Other variations are also possible, such as wherein one or two of the double bonds in one of the rings is hydrogenated, or wherein two or more substituents are joined together to form a ring, or the like.

Examples of suitable isoquinoline compounds include (1) 2-(N-butyl carbamoyl)-1,2,3,4-tetrahydro-isoquinoline (Aldrich 29,156-0), of the formula:

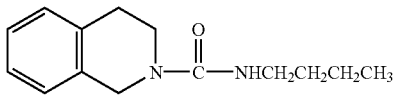

(2) 1-hydroxyisoquinoline (Aldrich 15,210-2), of the formula:

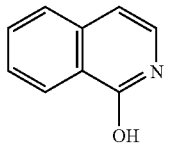

(3) 1-isoquinoline carboxylic acid (Aldrich 15,013-4), of the formula:

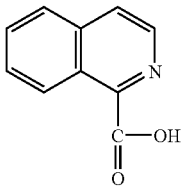

(4) 3-isoquinoline carboxylic acid (Aldrich 33,854-0), of the formula:

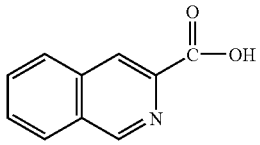

(5) 1,5-isoquinoline diol (Aldrich 28,191-3), of the formula:

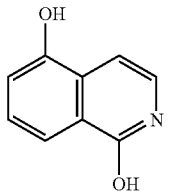

and the like.

The groups of quinoline compounds and isoquinoline compounds encompass quinoline salt compounds and isoquinoline salt compounds, which are of the same general formulae as quinoline and isoquinoline compounds except that they are associated with a compound of the general formula $xH_nY^{n-}$, wherein n is an integer of 1, 2, or 3, x is a number indicating the relative ratio between pyrrole or pyrrolidine and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof.

Examples of quinoline salt compounds include (1) 8-hydroxyquinoline hemisulfate hemihydrate (Aldrich 10,807-3), of the formula:

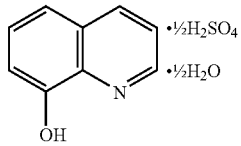

(2) 5-amino-8-hydroxy quinoline dihydrochloride (Aldrich 30,552-9), of the formula:

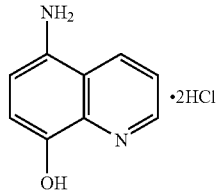

(3) 2-(chloromethyl) quinoline monohydrochloride (Aldrich C5,710-3), of the formula:

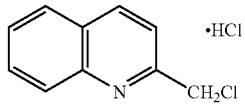

(4) 8-hydroxyquinoline-5-sulfonic acid monohydrate (Aldrich H5,875-7), of the formula:

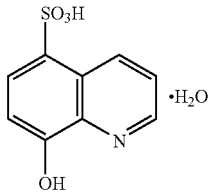

(5) 8-ethoxy-5-quinoline sulfonic acid sodium salt hydrate (Aldrich 17,346-0), of the formula:

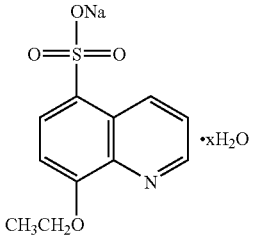

(6) 1,2,3,4-tetrahydroisoquinoline hydrochloride (Aldrich 30,754-8), of the formula:

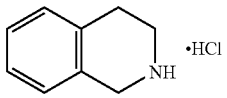

(7) 1,2,3,4-tetrahydro-3-isoquinoline carboxylic acid hydrochloride (Aldrich 21,493-0), of the formula:

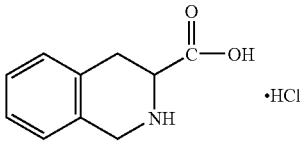

(8) 6,7-dimethoxy-1,2,3,4-tetrahydro isoquinoline hydrochloride (Aldrich 29,191-9), of the formula:

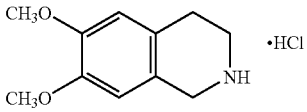

(9) 1-methyl-6,7-dihydroxy-1,2,3,4-tetrahydro isoquinoline hydrobromide (Aldrich 24,420-1), of the formula:

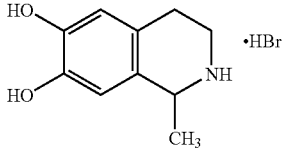

(10) primaquine diphosphate [8-(4-amino-1-methyl butyl amino)-6-methoxy quinoline diphosphate] (Aldrich 16,039-3), of the formula:

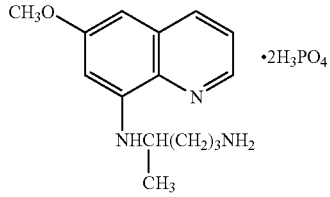

(11) pentaquine phosphate (Aldrich 30,207-4), of the formula

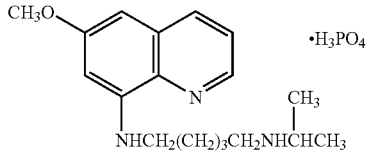

(12) dibucaine hydrochloride [2-butoxy-N-(2-diethyl amino ethyl)-4-quinoline carboxamide hydrochloride] (Aldrich 28,555-2), of the formula:

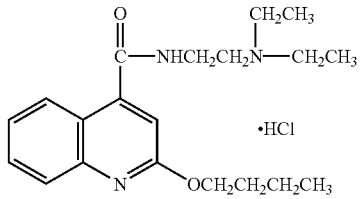

(13) 9-aminoacridine hydrochloride hemihydrate (Aldrich A3,840-1), of the formula:

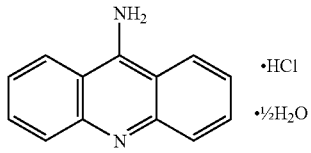

(14) 3,6-diamino acridine hemisulfate (Aldrich 19,822-6), of the formula:

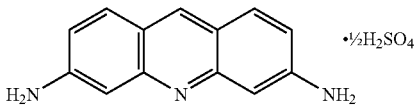

(15) 2-quinoline thiol hydrochloride (Aldrich 35,978-5), of the formula:

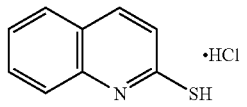

(16) (−) sparteine sulfate pentahydrate (Aldrich 23,466-4), of the formula:

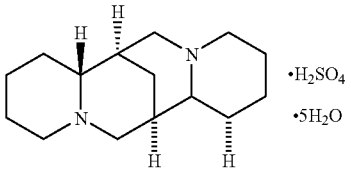

(17) papaverine hydrochloride (Aldrich 22,287-9), of the formula:

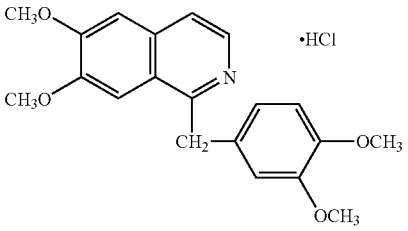

(18) (+)-emetine dihydrochloride hydrate (Aldrich 21,928-2), of the formula:

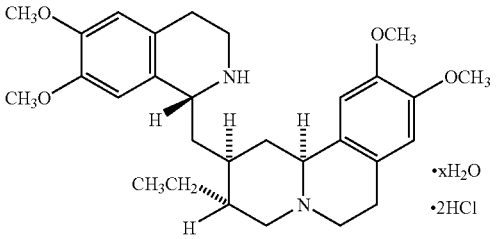

(19) 1,10-phenanthroline monohydrochloride monohydrate (Aldrich P1,300-2), of the formula:

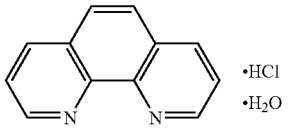

(20) neocuproine hydrochloride trihydrate (Aldrich 12,189-6), of the formula:

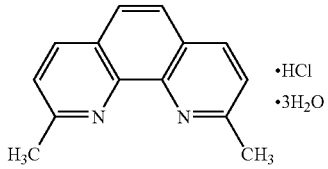

and the like.

Quinuclidine compounds are those of the general formula

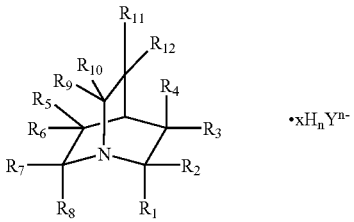

wherein $R_1$, $R_2$, $R_3$, $R_4$, $R_5$, $R_6$, $R_7$, $R_8$, $R_9$, $R_{10}$, $R_{11}$, and $R_{12}$ each, independently of one another, can be (but are not limited to) hydrogen, alkyl, substituted alkyl (such as alkyl hydroxyl, quinoline alkyl alcohol, or the like), hydroxyl, oxo, amino, vinyl, halide, or the like, and wherein n is an integer of 1, 2, or 3, x is a number indicating the relative ratio between pyrrole or pyrrolidine and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{23-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof. Other variations, however, are possible, such as when one of the carbon atoms forming the rings of the basic quinuclidine system is connected to another atom, such as carbon or oxygen, by a double bond.

Examples of suitable quinuclidine compounds include (1) quinuclidine hydrochloride (Aldrich 13,591-7), of the formula:

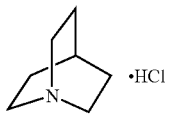

(2) 3-quinuclidinol hydrochloride (Aldrich Q188-3), of the formula:

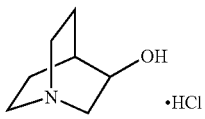

(3) 3-quinuclidinone hydrochloride (Aldrich Q190-5), of the formula:

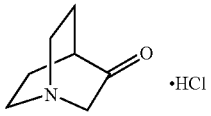

(4) 2-methylene-3-quinuclidinone dihydrate hydrochloride (Aldrich M4,612-8), of the formula:

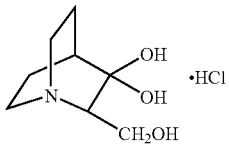

(5) 3-amino quinuclidine dihydrochloride (Aldrich 10,035-8), of the formula:

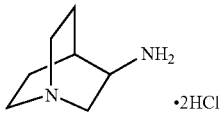

(6) 3-chloro quinuclidine hydrochloride (Aldrich 12,521-0), of the formula:

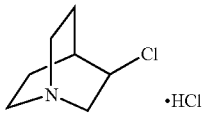

(7) quinidine sulfate dihydrate (Aldrich 14,589-0), of the formula:

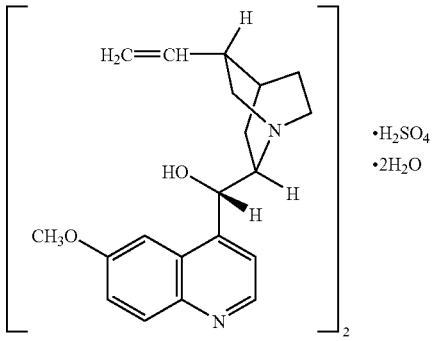

(8) quinine monohydrochloride dihydrate (Aldrich 14,592-0), of the formula:

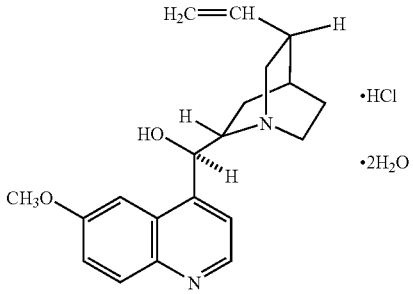

(9) quinine sulfate monohydrate (Aldrich 14,591-2), of the formula:

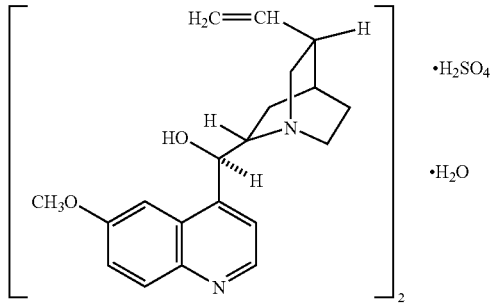

(10) hydroquinidine hydrochloride (Aldrich 25,481-9), of the formula:

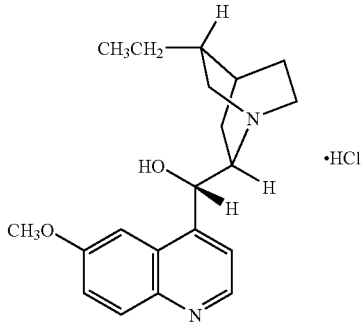

(11) hydroquinine hydrobromide dihydrate (Aldrich 34,132-0), of the formula:

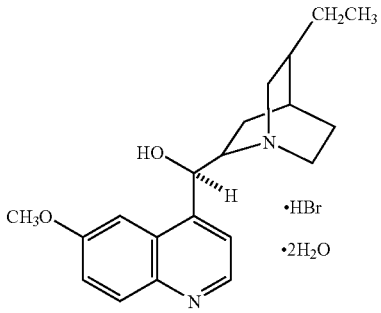

and the like.

Indole compounds are those of the general formula

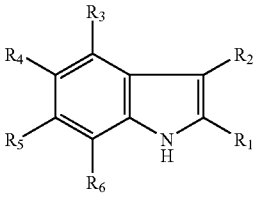

wherein $R_1$, $R_2$, $R_3$, $R_4$, $R_5$, and $R_6$ each, independently of one another, can be (but are not limited to) hydrogen, alkyl, substituted alkyl (such as alkyl hydroxyl, alkyl amide, alkyl carboxyl, alkyl carbonyl carboxyl, alkyl hydroxy carboxyl, acetamido alkyl carboxyl, alkyl phenyl carboxyl, or the like), aryl, substituted aryl, arylalkyl, substituted arylalkyl (such as alkyl phenyl carboxyl or the like), alkoxy, aldehyde, hydroxyl, acetate, carboxyl, acrylic carboxyl, carbonyl carboxyl, dione, and the like. Other variations are also possible, such as wherein one or more of the double bonds in either the five-membered ring or the six-membered ring are saturated, and/or wherein one or more of the ring carbon atoms is attached to another atom, such as carbon, oxygen, sulfur, or the like by a double bond, or the like.

Examples of suitable indole compounds include (1) indole (Aldrich I-340-8), of the formula:

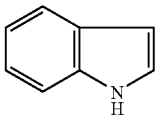

(2) 4,5,6,7-tetrahydroindole (Aldrich 32,490-6), of the formula:

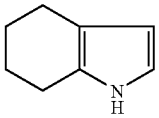

(3) 3-indolemethanol hydrate (Aldrich I-400-5), of the formula:

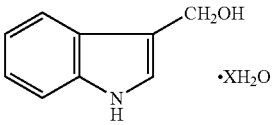

(4) 3-indole ethanol (tryptophol) (Aldrich T9,030-1), of the formula:

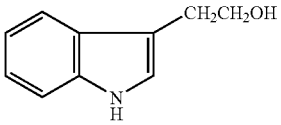

(5) indole-3-carboxaldehyde (Aldrich 12,944-5), of the formula.

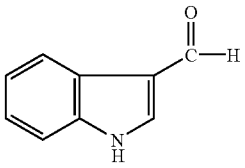

(6) 3-indolylacetate (3-acetoxyindole) (Aldrich 25,946-1), of the formula:

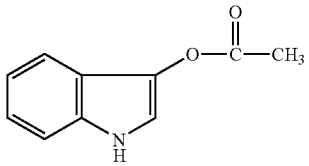

(7) indole-3-acetamide (Aldrich 28,628-1), of the formula:

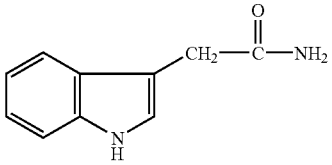

(8) indole-3-carboxylic acid (Aldrich 28,473-4), of the formula:

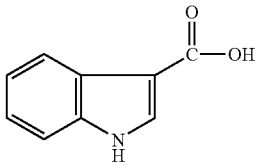

(9) indole-3-acetic acid (Aldrich I-375-0), of the formula:

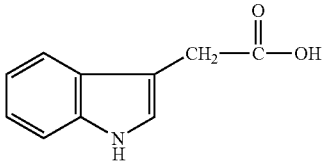

(10) 3-Indole propionic acid (Aldrich 22,002-7), of the formula:

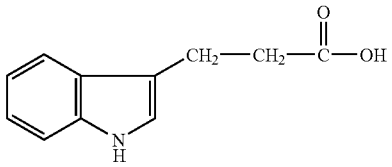

(11) 3-indole acrylic acid (Aldrich I-380-7), of the formula:

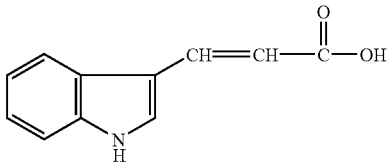

(12) 3-indole glyoxylic acid (Aldrich 22,001-9), of the formula:

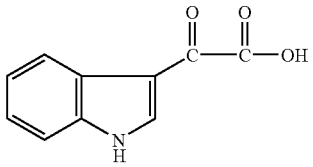

(13) indole-3-pyruvic acid (Aldrich I-556-7), of the formula:

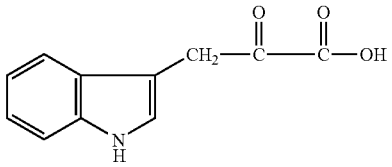

(14) D,L-3-indolelactic acid (Aldrich I-550-8), of the formula:

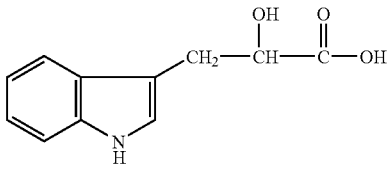

(15) 3-indole butyric acid (Aldrich 13,915-7), of the formula:

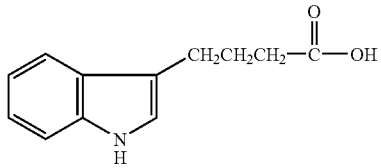

(16) N-acetyl-L-tryptophanamide (Aldrich 85,675-4), of the formula:

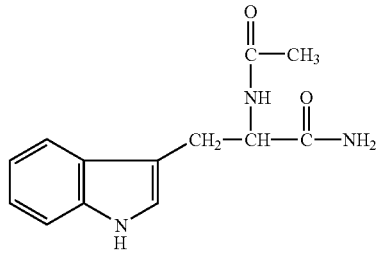

(17) N-(3-indolylacetyl)-L-alanine (Aldrich 34,591-1), of the formula:

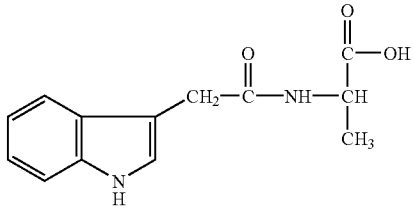

(18) N-(3-indolyl acetyl)-L-valine (Aldrich 34,792-2), of the formula:

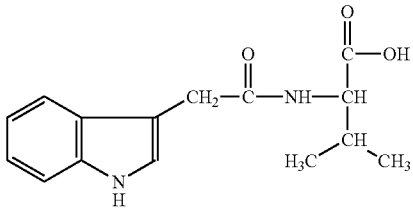

(19) N-(3-indolyl acetyl)-L-isoleucine (Aldrich 34,791-4), of the formula:

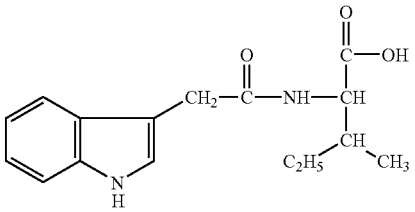

(20) N-(3-indolyl acetyl)-L-leucine (Aldrich 34,594-6), of the formula:

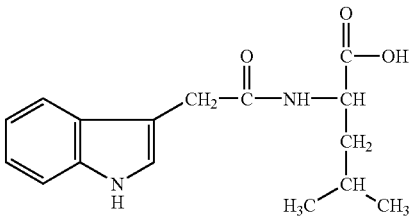

(21) N-(3-indolyl acetyl)-D,L-aspartic acid (Aldrich 34,593-8), of the formula:

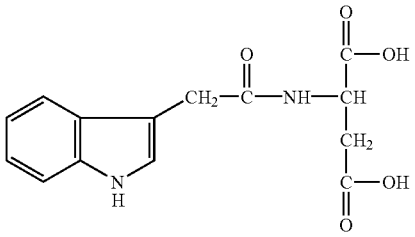

(22) N-(3-indolyl acetyl)-L-phenylalanine (Aldrich 34,595-4), of the formula:

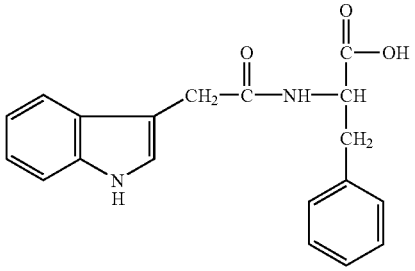

(23) 4-hydroxyindole (4-Indolol) (Aldrich 21,987-8), of the formula:

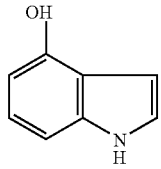

(24) indole-4-carboxylic acid (Aldrich 24,626-3), of the formula:

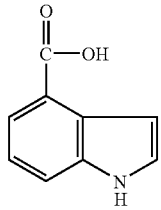

(25) 4-indolyl acetate (Aldrich 25,904-7), of the formula:

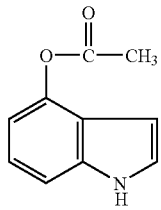

(26) 4-methyl indole (Aldrich 24,630-1), of the formula:

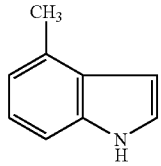

(27) 5-hydroxy indole (5-indolol) (Aldrich H3,185-9), of the formula:

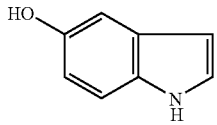

(28) 5-hydroxy indole-3-acetic acid (Aldrich H3,200-6), of the formula:

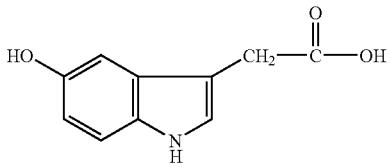

(29) 5-hydroxy-2-indole carboxylic acid (Aldrich 14,351-0), of the formula:

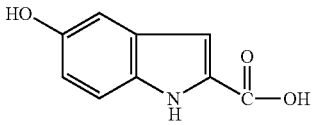

(30) N-acetyl-5-hydroxytryptamine (Aldrich 85,548-0), of the formula:

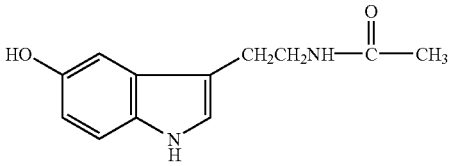

(31) indole-5-carboxylic acid (Aldrich I-540-0), of the formula:

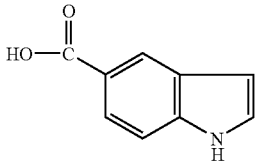

(32) 5-methyl indole (Aldrich 22,241-0), of the formula:

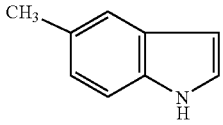

(33) 5-methoxy indole (Aldrich M,1490-0), of the formula:

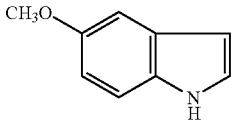

(34) indole-2-carboxylic acid (Aldrich I-510-9), of the formula:

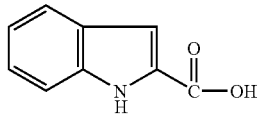

(35) D,L-indolene-2-carboxylic acid (Aldrich 30,224-4), of the formula:

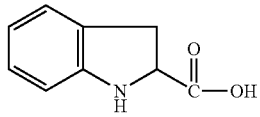

(36) indole-2,3-dione (isatin) (Aldrich 11,461-8), of the formula:

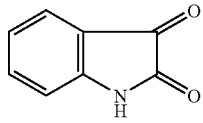

(37) 2-methyl indole (Aldrich M5,140-7), of the formula:

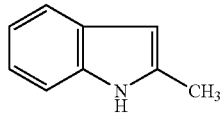

(38) 2,3,3-trimethyl indolenine (Aldrich T7,680-5), of the formula:

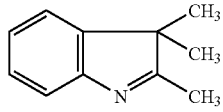

and the like.

Indazole compounds are of the general formula

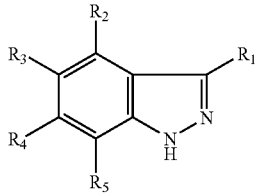

wherein $R_1$, $R_2$, $R_3$, $R_4$, and $R_5$ each, independently of one another, can be (but are not limited to) hydrogen, alkyl, substituted alkyl (such as alkyl amine, or the like), aryl (such as phenyl or the like), substituted aryl (such as phenyl hydrazine or the like), amino, oxo, sulfanilamide, pyridinyl, hydroxyl, alkoxy, hydrazine, isothiouronium, isoquinoline, substituted isoquinoline, and the like. Other variations are also possible, such as wherein one or more of the double bonds in either the five-membered ring or the six-membered ring is saturated, or wherein two or more substituents are joined to form another ring, or the like.

Examples of indazole compounds include (1) indazole (Aldrich 1,240-1), of the formula:

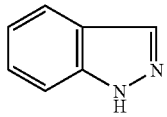

(2) 5-aminoindazole (Aldrich A5,955-7), of the formula:

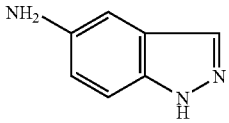

(3) 6-aminoindazole (Aldrich A5,956-5), of the formula:

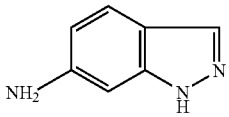

(4) 3-indazolinone (Aldrich I 260-6), of the formula:

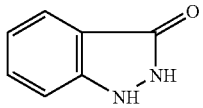

(5) N'-(6-indazolyl) sulfanilamide (Aldrich 15,530-6), of the formula:

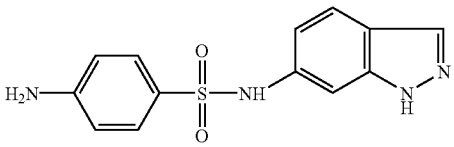

(6) 4,5-dihydro-3-(4-pyridinyl)-2H-benz[g] indazole methane sulfonate (Aldrich 21,413-2), of the formula:

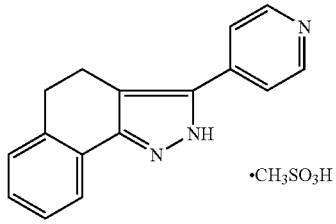

and the like.

The general group of indole compounds encompasses indole salts, which are of the same general formula as indole compounds except that they are associated with compounds of the formula $xH_nY^{n-}$, wherein n is an integer of 1, 2, or 3, x is a number indicating the relative ratio between pyrrole or pyrrolidine and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof.

Examples of indole salts include (1) tryptamine hydrochloride (Aldrich 13,224-1), of the formula:

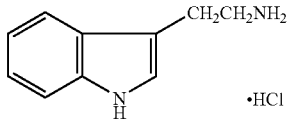

(2) 5-methyl tryptamine hydrochloride (Aldrich 13,422-8), of the formula:

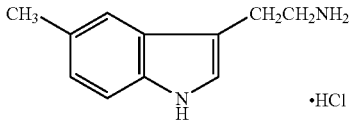

(3) serotonin hydrochloride hemihydrate (5-hydroxy tryptamine hydrochloride hemihydrate) (Aldrich 23,390-0), of the formula:

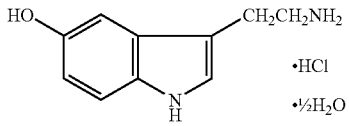

(4) norharman hydrochloride monohydrate (Aldrich 28,687-7), of the formula:

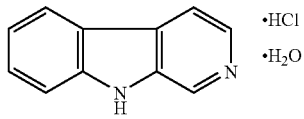

(5) harmane hydrochloride monohydrate (Aldrich 25,051-1), of the formula:

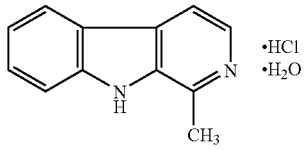

(6) harmine hydrochloride hydrate (Aldrich 12,848-1), of the formula:

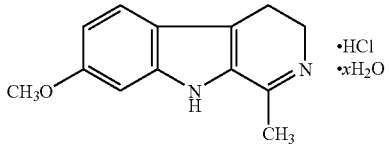

(7) harmaline hydrochloride dehydrate (Aldrich H 10-9), of the formula:

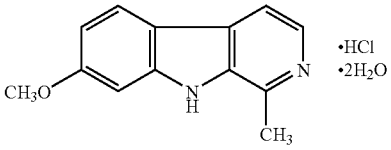

(8) harmol hydrochloride dihydrate (Aldrich 11,655-6), of the formula:

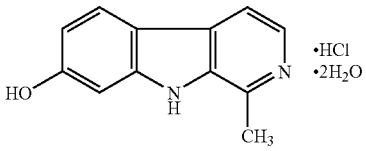

(9) harmalol hydrochloride dihydrate (Aldrich H 12-5), of the formula:

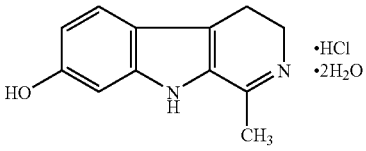

(10) 3,6-diamino acridine hydrochloride (Aldrich 13,110-5), of the formula:

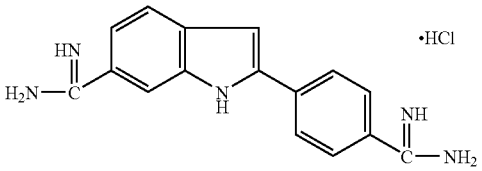

(11) S-(3-indolyl) isothiuronium iodide (Aldrich 16,097-0), of the formula:

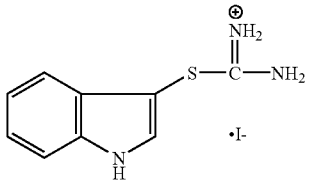

(12) yohimbine hydrochloride (Aldrich Y20-8), of the formula:

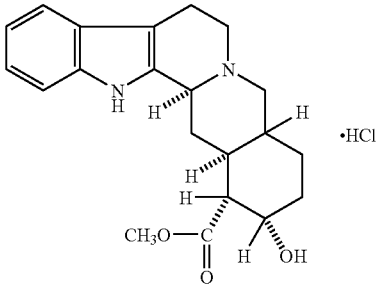

(13) 4,5-dihydro-3-(4-pyridinyl)-2H-benz[g] indazole methane sulfonate (Aldrich 21,413-2), of the formula:

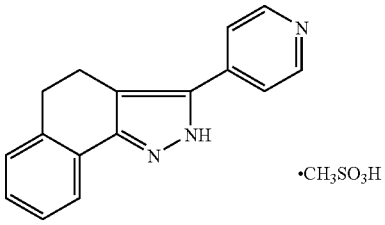

and the like.

Mixtures of any two or more of the above materials can also be employed.

The pyrrole compound, pyrrolidine compound, pyridine compound, piperidine compound, homopiperidine compound, quinoline compound, isoquinoline compound, quinuclidine compound, indole compound, indazole compound, or mixture thereof is present in any effective amount relative to the substrate. Typically, the pyrrole compound, pyrrolidine compound, pyridine compound, piperidine compound, homopiperidine compound, quinoline compound, isoquinoline compound, quinuclidine compound, indole compound, indazole compound, or mixture thereof is present in an amount of from about 1 to about 50 percent by weight of the substrate, preferably from about 5 to about 30 percent by weight of the substrate, although the amount can be outside this range. The amount can also be expressed in terms of the weight of pyrrole compound, pyrrolidine compound, pyridine compound, piperidine compound, homopiperidine compound, quinoline compound, isoquinoline compound, quinuclidine compound, indole compound, indazole compound, or mixture thereof per unit area of substrate. Typically, the pyrrole compound, pyrrolidine compound, pyridine compound, piperidine compound, homopiperidine compound, quinoline compound, isoquinoline compound, quinuclidine compound, indole compound, indazole compound, or mixture thereof is present in an amount of from about 0.8 to about 40 grams per square meter of the substrate surface to which it is applied, and preferably from about 4 to about 24 grams per square meter of the substrate surface to which it is applied, although the amount can be outside these ranges.

When the pyrrole compound, pyrrolidine compound, pyridine compound, piperidine compound, homopiperidine compound, quinoline compound, isoquinoline compound, quinuclidine compound, indole compound, indazole compound, or mixture thereof is applied to the substrate as a coating, the coatings employed for the recording sheets of the present invention can include an optional binder in addition to the pyrrole compound, pyrrolidine compound, pyridine compound, piperidine compound, homopiperidine compound, quinoline compound, isoquinoline compound, quinuclidine compound, indole compound, indazole compound, or mixture thereof. Examples of suitable binder polymers include (a) hydrophilic polysaccharides and their modifications, such as (1) starch (such as starch SLS-280, available from St. Lawrence starch), (2) cationic starch (such as Cato-72, available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382, available from Poly Sciences Inc.) and hydroxyethyl starch (#06733, available from Poly Sciences Inc.)), (4) gelatin (such as Calfskin gelatin #00639, available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose (Methocel AM 4, available from Dow Chemical Company)), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose (Natrosol 250 LR, available from Hercules Chemical Company), and hydroxypropyl cellulose (Klucel Type E, available from Hercules Chemical Company)), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose (Bermocoll, available from Berol Kern. A. B. Sweden)), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose (HEM, available from British Celanese Ltd . also available as Tylose MH, MHK from Kalle A. G.), hydroxypropyl methyl cellulose (Methocel K35LV, available from Dow Chemical Company), and hydroxy butylmethyl cellulose (such as HBMC, available from Dow Chemical Company)), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose, available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans, available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF, available from Hercules Chemical Company), (20) gum arabic (such as #G9752, available from Sigma Chemical Company), (21) carrageenan (such as #C1013 available from Sigma Chemical Company), (22) Karaya gum (such as #G0503, available from Sigma Chemical Company), (23) xanthan (such as Keltrol-T, available from Kelco division of Merck and Company), (24) chitosan (such as #C3646, available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats), (29) agar-agar (such as that available from Pfaltz and Bauer Inc), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from Dupont Chemical Company), (2) poly (vinyl phosphate) (such as #4391 available from Poly Sciences Inc.), (3) poly (vinyl pyrrolidone) (such as that available from GAF Corporation), (4) vinyl pyrrolidone-vinyl acetate copolymers (such as #02587, available from Poly Sciences Inc.), (5) vinyl pyrrolidone-styrene copolymers (such as #371, available from Scientific Polymer Products), (6) poly (vinylamine) (such as #1562, available from Poly Sciences Inc.), (7) poly (vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl alcohol) ethoxylated #6573, available from Poly Sciences Inc.), and (8) poly (vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl pyrrolidone-diethylaminomethylmethacrylate) #16294 and #16295, available from Poly Sciences Inc.); (c) formaldehyde resins, such as (1) melamine-formaldehyde resin (such as BC 309, available from British Industrial Plastics Limited), (2) urea-formaldehyde resin (such as BC777, available from British Industrial Plastics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins, available from American Cyanamid Company as Beetle 65); (d) ionic polymers, such as (1) poly (2-acrylamide-2-methyl propane sulfonic acid) (such as #175 available from Scientific Polymer Products), (2) poly (N,N-dimethyl-3,5-dimethylene piperidinium chloride) (such as #401, available from Scientific Polymer Products), and (3) poly (methylene-guanidine) hydrochloride (such as #654, available from Scientific Polymer Products); (e) latex polymers, such as (1) cationic, anionic, and nonionic styrene-butadiene latexes (such as that available from Gen Corp Polymer Products, such as RES 4040 and RES 4100, available from Unocal Chemicals, and such as DL 6672A, DL6638A, and DL6663A, available from Dow Chemical Company), (2) ethylene-vinylacetate latex (such as Airflex 400, available from Air Products and Chemicals Inc.), (3) vinyl acetate-acrylic copolymer latexes (such as synthemul 97-726, available from Reichhold Chemical Inc, Resyn 25-1110 and Resyn 25-1140, available from National Starch Company, and RES 3103 available from Unocal Chemicals, (4) quaternary acrylic copolymer latexes, particularly those of the formula

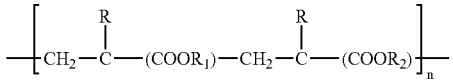

wherein n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like; (f) maleic anhydride and maleic acid containing polymers, such as (1) styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products), (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as EMA from Monsanto Chemical Company), (4) butadiene-maleic acid copolymers (such as #07787, available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporation as Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773, available from Scientific Polymer Products); (g) acrylamide containing polymers, such as (1) poly (acrylamide) (such as #02806, available from Poly Sciences Inc.), (2) acrylamide-acrylic acid copolymers (such as #04652, #02220, and #18545, available from Poly Sciences Inc.), and (3) poly (N,N-dimethyl acrylamide) (such as #004590, available from Poly Sciences Inc.); and (h) poly (alkylene imine) containing polymers, wherein alkylene has two (ethylene), three (propylene), or four (butylene) carbon atoms, such as (1) poly(ethylene imine) (such as #135, available from Scientific Polymer Products), (2) poly(ethylene imine) epichlorohydrin (such as #634, available from Scientific Polymer Products), and (3) alkoxylated poly (ethylene imine), wherein alkyl has one (methoxylated), two (ethoxylated), three (propoxylated), or four (butoxylated) carbon atoms (such as ethoxylated poly (ethylene imine #636, available from Scientific Polymer Products); and the like, as well as blends or mixtures of any of the above, with starches and latexes being particularly preferred because of their availability and applicability to paper. Any mixtures of the above ingredients in any relative amounts can be employed.

If present, the binder can be present within the coating in any effective amount; typically the binder and the pyrrole compound, pyrrolidine compound, pyridine compound, piperidine compound, homopiperidine compound, quinoline compound, isoquinoline compound, quinuclidine compound, indole compound, indazole compound, or mixture thereof are present in relative amounts of from about 10 percent by weight binder and about 90 percent by weight pyrrole compound, pyrrolidine compound, pyridine compound, piperidine compound, homopiperidine compound, quinoline compound, isoquinoline compound, quinuclidine compound, indole compound, indazole compound, or mixture thereof to about 99 percent by weight binder and about 1 percent by weight pyrrole compound, pyrrolidine compound, pyridine compound, piperidine compound, homopiperidine compound, quinoline compound, isoquinoline compound, quinuclidine compound, indole compound, indazole compound, or mixture thereof, although the relative amounts can be outside of this range.

In addition, the coating of the recording sheets of the present invention can contain optional antistatic agents. Any suitable or desired antistatic agent or agents can be employed, such as quaternary salts and other materials as disclosed in, for example, U.S. Pat. Nos. 5,760,809; 5,314,717; 5,441,795; 5,320,902; 5,457,486, the disclosures of each of which are totally incorporated herein by reference. The antistatic agent can be present in any effective amount; typically, the antistatic agent is present in an amount of from about 1 to about 5 percent by weight of the coating, and preferably in an amount of from about 1 to about 2 percent by weight of the coating, although the amount can be outside these ranges.

Further, the coating of the recording sheets of the present invention can contain one or more optional biocides. Examples of suitable biocides include (A) non-ionic biocides, such as (1) 2-hydroxypropylmethane thiosulfonate (Busan 1005, available from Buckman Laboratories Inc.); (2) 2-(thio cyanomethyl thio) benzothiazole (Busan 30WB, 72WB, available from Buckman Laboratories Inc.); (3) methylene bis (thiocyanate) (Metasol T-10, available from Calgon Corporation; AMA-110, available from Vinings Chemical Company; Vichem MBT, available from Vineland Chemical Company; Aldrich 10,509-0); (4) 2-bromo-4'-hydroxyacetophenone (Busan 90, available from Buckman Laboratories); (5) 1,2-dibromo-2,4-dicyanobutane (Metasol CB-210, CB-235, available from Calgon Corporation); (6) 2,2-dibromo-3-nitropropionamide (Metasol RB-20, available from Calgon Corporation; Amerstat 300, available from Drew Industrial Div.); (7) N-α-(1-nitroethyl benzylethylene diamine) (Metasol J-26, available from Calgon Corporation); (8) dichlorophene (G-4, available from Givaudan Corporation); (9) 3,5-dimethyl tetrahydro-2H-1,3,5-thiadiazine-2-thione (SLIME-TROL RX-28, available from Betz Paper Chem Inc.; Metasol D3T-A, available from Calgon Corporation; SLIME ARREST, available from Western Chemical Company); (10) a non-ionic blend of a sulfone, such as bis (trichloromethyl) sulfone and methylene bisthiocyanate (available as SLIME-TROL RX-38A from Betz Paper Chem Inc.); (11) a non-ionic blend of methylene bisthiocyanate and bromonitrostyrene (available as SLIME-TROL RX-41 from Betz Paper Chem Inc.); (12) a non-ionic blend of 2-(thiocyanomethylthio) benzothiazole (53.2% by weight) and 2-hydroxypropyl methanethiosulfonate (46.8% by weight) (available as BUSAN 25 from Buckman Laboratories Inc.); (13) a non-ionic blend of methylene bis (thiocyanate) 50 percent by weight and 2-(thiocyanomethylthio) benzothiazole 50 percent by weight (available as BUSAN 1009, 1009WB from Buckman Laboratories Inc.); (14) a non-ionic blend of 2-bromo-4'-hydroxyacetophenone (70 percent by weight) and 2-(thiocyanomethylthio) benzothiazole (30 percent by weight) (BUSAN 93, available from Buckman Laboratories Inc.); (15) a non-ionic blend of 5-chloro-2-methyl-4-isothiazoline-3-one (75 percent by weight) and 2-methyl-4-isothiazolin-3-one (25 percent by weight), (available as AMERSTAT 250 from Drew Industrial Division; NALCON 7647, from NALCO Chemical Company;Kathon LY, from Rohm and Haas Co.); and the like, as well as mixtures thereof; (B) anionic biocides, such as (1) anionic potassium N-hydroxymethyl-N-methyl-dithiocarbamate (available as BUSAN 40 from Buckman Laboratories Inc.); (2) an anionic blend of N-hydroxymethyl-N-methyl dithiocarbamate (80% by weight) and sodium 2-mercapto benzothiazole (20% by weight) (available as BUSAN 52 from Buckman Laboratories Inc.); (3) an anionic blend of sodium dimethyl dithiocarbamate 50 percent by weight and (disodium ethylenebis-dithiocarbamate) 50% by weight (available as METASOL 300 from Calgon Corporation; AMERSTAT 272 from Drew Industrial Division; SLIME CONTROL F from Western Chemical Company); (4) an anionic blend of N-methyldithiocarbamate 60 percent by weight and disodium cyanodithioimidocarbonate 40 percent by weight (available as BUSAN 881 from Buckman Laboratories Inc); (5) An anionic blend of methylene bis-thiocyanate (33% by weight), sodium dimethyldithiocarbamate (33% by weight), and sodium ethylene bisdithiocarbamate (33% by weight) (available as AMERSTAT 282 from Drew Industrial Division; AMA-131 from Vinings Chemical Company); (6) sodium dichlorophene (G-4-40, available from Givaudan Corp.); and the like, as well as mixtures thereof; (C) cationic biocides, such as (1) cationic poly (oxyethylene (dimethylamino)-ethylene (dimethylamino) ethylene dichloride) (Busan 77, available from Buckman Laboratories Inc.); (2) a cationic blend of methylene bisthiocyanate and dodecyl guanidine hydrochloride (available as SLIME TROL RX-31, RX-32, RX-32P, RX-33, from Betz Paper Chem Inc.); (3) a cationic blend of a sulfone, such as bis(trichloromethyl) sulfone and a quaternary ammonium chloride (available as SLIME TROL RX-36 DPB-865 from Betz Paper Chem. Inc.); (4) a cationic blend of methylene bis thiocyanate and chlorinated phenols (available as SLIME-TROL RX-40 from Betz Paper Chem Inc.); and the like, as well as mixtures thereof. The biocide can be present in any effective amount; typically, the biocide is present in an amount of from about 10 parts per million to about 3 percent by weight of the coating, although the amount can be outside this range.

Additionally, the coating of the recording sheets of the present invention can contain optional filler components. Fillers can be present in any effective amount, and if present, typically are present in amounts of from about 1 to about 60 percent by weight of the coating composition. Examples of filler components include colloidal silicas, such as Syloid 74, available from Grace Company (preferably present, in one embodiment, in an amount of about 20 weight percent), titanium dioxide (available as Rutile or Anatase from NL Chem Canada, Inc.), hydrated alumina (Hydrad Trv MC-HBF, Hydrad TM-HBC, available from J. M Huber Corporation n), barium sulfate (K. C. Blanc Fix HD80, available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blend of calcium fluoride and silica, such as Opalex-C available from Kemira. O. Y, zinc oxide, such as Zoco Fax 183, available from Zo Chem, blends of zinc sulfide with barium sulfate, such as Lithopane, available from Schteben Company, and the like, as well as mixtures thereof. Brightener fillers can enhance color mixing and assist in improving print-through in recording sheets of the present invention.

The coating containing the pyrrole compound, pyrrolidine compound, pyridine compound, piperidine compound, homopiperidine compound, quinoline compound, isoquinoline compound, quinuclidine compound, indole compound, indazole compound, or mixture thereof is present on the substrate of the recording sheet of the present invention in any effective thickness. Typically, the total thickness of the coating layer (on each side, when both surfaces of the substrate are coated) is from about 1 to about 25 microns and preferably from about 5 to about 10 microns, although the thickness can be outside of these ranges.

The pyrrole compound, pyrrolidine compound, pyridine compound, piperidine compound, homopiperidine compound, quinoline compound, isoquinoline compound, quinuclidine compound, indole compound, indazole compound, or mixture thereof or the mixture of pyrrole compound, pyrrolidine compound, pyridine compound, piperidine compound, homopiperidine compound, quinoline compound, isoquinoline compound, quinuclidine compound, indole compound, indazole compound, or mixture thereof, optional binder, optional antistatic agent, optional biocide, and/or optional filler can be applied to the substrate by any suitable technique, such as size press treatment, dip coating, reverse roll coating, extrusion coating, or the like. For example, the coating can be applied with a KRK size press (Kumagai Riki Kogyo Co., Ltd., Nerima, Tokyo, Japan) by dip coating and can be applied by solvent extrusion on a Faustel Coater. The KRK size press is a lab size press that simulates a commercial size press. This size press is normally sheet fed, whereas a commercial size press typically employs a continuous web. On the KRK size press, the substrate sheet is taped by one end to the carrier mechanism plate. The speed of the test and the roll pressures are set, and the coating solution is poured into the solution tank. A 4 liter stainless steel beaker is situated underneath for retaining the solution overflow. The coating solution is cycled once through the system (without moving the substrate sheet) to wet the surface of the rolls and then returned to the feed tank, where it is cycled a second time. While the rolls are being "wetted", the sheet is fed through the sizing rolls by pressing the carrier mechanism start button. The coated sheet is then removed from the carrier mechanism plate and is placed on a 12 inch by 40 inch sheet of 750 micron thick Teflon for support and is dried on the Dynamic Former drying drum and held under restraint to prevent shrinkage. The drying temperature is approximately 105° C. This method of coating treats both sides of the substrate simultaneously.

In dip coating, a web of the material to be coated is transported below the surface of the liquid coating composition by a single roll in such a manner that the exposed site is saturated, followed by removal of any excess coating by the squeeze rolls and drying at 100° C. in an air dryer. The liquid coating composition generally comprises the desired coating composition dissolved in a solvent such as water, methanol, or the like. The method of surface treating the substrate using a coater results in a continuous sheet of substrate with the coating material applied first to one side and then to the second side of this substrate. The substrate can also be coated by a slot extrusion process, wherein a flat die is situated with the die lips in close proximity to the web of substrate to be coated, resulting in a continuous film of the coating solution evenly distributed across one surface of the sheet, followed by drying in an air dryer at 100° C.

Recording sheets of the present invention can be employed in ink jet printing processes. One embodiment of the present invention is directed to a process which comprises applying an aqueous recording liquid to a recording sheet of the present invention in an imagewise pattern. Another embodiment of the present invention is directed to a printing process which comprises (1) incorporating into an ink jet printing apparatus containing an aqueous ink a recording sheet of the present invention, and (2) causing droplets of the ink to be ejected in an imagewise pattern onto the recording sheet, thereby generating images on the recording sheet. Ink jet printing processes are well known, and are described in, for example, U.S. Pat. Nos. 4,601,777, 4,251,824, 4,410,899, 4,412,224, and 4,532,530, the disclosures of each of which are totally incorporated herein by reference. In a particularly preferred embodiment, the printing apparatus employs a thermal ink jet process wherein the ink in the nozzles is selectively heated in an imagewise pattern, thereby causing droplets of the ink to be ejected in imagewise pattern. In another preferred embodiment, the substrate is printed with an aqueous ink and thereafter the printed substrate is exposed to microwave radiation, thereby drying the ink on the sheet. Printing processes of this nature are disclosed in, for example, U.S. Pat. No. 5,220,346, the disclosure of which is totally incorporated herein by reference.

The recording sheets of the present invention can also be used in any other printing or imaging process, such as printing with pen plotters, handwriting with ink pens, offset printing processes, or the like, provided that the ink employed to form the image is compatible with the ink receiving layer of the recording sheet.

Recording sheets of the present invention exhibit reduced curl upon being printed with aqueous inks, particularly in situations wherein the ink image is dried by exposure to microwave radiation. Generally, the term "curl" refers to the distance between the base line of the arc formed by recording sheet when viewed in cross-section across its width (or shorter dimension—for example, 8.5 inches in an 8.5×11 inch sheet, as opposed to length, or longer dimension—for example, 11 inches in an 8.5×11 inch sheet) and the midpoint of the arc. To measure curl, a sheet can be held with the thumb and forefinger in the middle of one of the long edges of the sheet (for example, in the middle of one of the 11 inch edges in an 8.5×11 inch sheet) and the arc formed by the sheet can be matched against a pre-drawn standard template curve.

Specific embodiments of the invention will now be described in detail. These examples are intended to be illustrative, and the invention is not limited to the materials, conditions, or process parameters set forth in these embodiments. All parts and percentages are by weight unless otherwise indicated.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

EXAMPLE I

Transparency sheets were prepared as follows. Blends of 70 percent by weight hydroxypropyl methyl cellulose (K35LV, obtained from Dow Chemical Co.) and 30 percent by weight of various additive compositions, each obtained from Aldrich Chemical Co., were prepared by mixing 56 grams of hydroxypropyl methyl cellulose and 24 grams of the additive composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. For comparison purposes, a transparency sheet was also prepared in which the coating consisted of 100 percent by weight hydroxypropyl methyl cellulose and contained no additive composition.

The transparency sheets thus prepared were incorporated into a Hewlett-Packard 500–C color ink jet printer containing inks of the following compositions:

| | |
|---|---|
| Cyan: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 30 percent by weight Projet Cyan 1 dye, obtained from ICI, 45.45 percent by weight water. |
| Magenta: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 2.5 percent by weight Triton Direct Red 227, obtained from Tricon, 72.95 percent by weight water. |
| Yellow: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water. |

Images were generated by printing block patterns for magenta, cyan, yellow, and black. The images thus formed were dried by exposure to microwave radiation with a Citizen Model No. JM55581, obtained from Consumers, Mississauga, Ontario, Canada, set at 700 Watts output power at 2450 MHz frequency. The black images were "process black" (i.e., formed by superimposition of cyan, magenta, and yellow images). The drying times and optical densities for the resulting images were as follows:

| | Drying Time (seconds) | | | | Optical Density | | | |
|---|---|---|---|---|---|---|---|---|
| Additive | black | cyan | magenta | yellow | black | cyan | magenta | yellow |
| none | 30 | 20 | 30 | 20 | 2.50 | 2.07 | 1.45 | 0.99 |
| 1-benzyl-3-piperidone hydrochloride hydrate | 20 | 40 | 10 | 20 | 1.85 | 1.68 | 1.50 | 0.95 |

-continued

| Additive | Drying Time (seconds) | | | | Optical Density | | | |
|---|---|---|---|---|---|---|---|---|
| | black | cyan | magenta | yellow | black | cyan | magenta | yellow |
| 2-(2-methylamino ethyl) pyridine dihydrochloride | 20 | 15 | 25 | 15 | 1.85 | 2.10 | 1.52 | 0.97 |
| D,L-pipecolinic acid hydrochloride | 10 | 30 | 30 | 20 | 1.87 | 1.90 | 1.53 | 0.98 |
| 8-ethoxy-5-quinoline sulfonic acid sodium salt | 10 | 20 | 20 | 20 | 1.75 | 1.70 | 1.30 | 0.90 |

As the results indicate, the drying times of all colors were equivalent or faster in the presence of the additives than in their absence. In addition, the optical densities of the images were also acceptable and in some instances were improved.

EXAMPLE II

Transparency sheets were prepared as follows. Blends of 54 percent by weight hydroxypropyl methyl cellulose (K35LV, obtained from Dow Chemical Co.), 36 percent by weight poly(ethylene oxide) (POLY OX WSRN-3000, obtained from Union Carbide Corp., and 10 percent by weight of various additive compositions, each obtained from Aldrich Chemical Co., were prepared by mixing 43.2 grams of hydroxypropyl methyl cellulose, 28.8 grams of poly (ethylene oxide), and 8 grams of the additive composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. For comparison purposes, a transparency sheet was also prepared in which the coating consisted of 60 percent by weight hydroxypropyl methyl cellulose and 40 percent by weight poly(ethylene oxide) and contained no additive composition.

The transparency sheets thus prepared were incorporated into a Hewlett-Packard 500-C color ink jet printer containing inks of the following compositions:

| | |
|---|---|
| Cyan: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 30 percent by weight Projet Cyan 1 dye, obtained from ICI, 45.45 percent by weight water. |
| Magenta: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 2.5 percent by weight Triton Direct Red 227, obtained from Tricon, 72.95 percent by weight water. |
| Yellow: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water. |

Images were generated by printing block patterns for magenta, cyan, yellow, and black. The images thus formed were allowed to dry at 25° C. The black images were "process black" (i.e., formed by superimposition of cyan, magenta, and yellow images). The drying times and optical densities for the resulting images were as follows:

| Additive | Drying Time (minutes) | | | | Optical Density | | | |
|---|---|---|---|---|---|---|---|---|
| | black | cyan | magenta | yellow | black | cyan | magenta | yellow |
| none | 15 | 10 | 10 | 10 | 1.40 | 1.46 | 1.34 | 1.02 |
| 1-amino-pyrrolidine hydrochloride | 10 | 6 | 5 | 5 | 1.44 | 1.38 | 1.28 | 0.93 |
| L-proline methyl ester hydrochloride | 8 | 5 | 5 | 5 | 1.42 | 1.40 | 1.23 | 0.95 |
| 4,4'-bipiperidine hydrochloride | 7 | 4 | 4 | 4 | 1.38 | 1.40 | 1.26 | 0.93 |
| pyridoxine hydrochloride | 7 | 5 | 4 | 4 | 1.40 | 1.38 | 1.02 | 0.84 |

As the results indicate, As the results indicate, the drying times of the transparencies containing the additives were generally faster than the drying times of the transparency containing no additives. In addition, the optical densities of the images on the transparencies containing the additives were acceptable in all instances.

EXAMPLE III

Transparency sheets were prepared as follows. Blends of 90 percent by weight hydroxypropyl methyl cellulose (K35LV, obtained from Dow Chemical Co.) and 10 percent by weight of various additive compositions, each obtained from Aldrich Chemical Co., were prepared by mixing 72 grams of hydroxypropyl methyl cellulose and 8 grams of the additive composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. For comparison purposes, a transparency sheet was also prepared in which the coating consisted of 100 percent by weight hydroxypropyl methyl cellulose and contained no additive composition.

The transparency sheets thus prepared were incorporated into a Hewlett-Packard 500-C color ink jet printer containing inks of the following compositions:

| | |
|---|---|
| Cyan: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 30 percent by weight Projet Cyan 1 dye, obtained from ICI, 45.45 percent by weight water. |
| Magenta: | 20 percent by weight ethylene glycol, 2.5 percent by weight benzyl alcohol. 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 2.5 percent by weight Triton Direct Red 227, obtained from Tricon, 72.95 percent by weight water. |
| Yellow: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water. |

Images were generated by printing block patterns for magenta, cyan, yellow, and black. The images thus formed were allowed to dry at 25° C. The black images were "process black" (i.e., formed by superimposition of cyan, magenta, and yellow images). The drying times and optical densities for theresulting images were as follows:

| | Drying Time (minutes) | | | | Optical Density | | | |
|---|---|---|---|---|---|---|---|---|
| Additive | black | cyan | ma-genta | yel-low | black | cyan | ma-genta | yel-low |
| none | 10 | 5 | 5 | 2 | 2.95 | 2.10 | 1.37 | 0.99 |
| 1-benzyl-3-piperidone hydrochloride hydrate | 6 | 3 | 3 | 2 | 2.90 | 2.12 | 1.40 | 0.95 |
| 2-imino-piperidine hydrochloride | 6 | 3 | 3 | 2 | 1.60 | 1.80 | 1.40 | 0.95 |
| 2-(2-methylamino ethyl) pyridine dihydrochloride | 7 | 3 | 5 | 1 | 1.50 | 2.20 | 1.53 | 0.92 |
| D,L-pipecolinic acid hydrochloride | 5 | 1.5 | 3 | 1 | 1.68 | 2.05 | 1.50 | 0.90 |
| 8-ethoxy-5-quinoline sulfonic acid sodium salt | 8 | 4 | 4 | 1.5 | 1.70 | 1.85 | 1.38 | 0.86 |
| 3-quinuclidinol hydrochloride | 6 | 3 | 3 | 2 | 1.50 | 1.93 | 1.51 | 0.97 |
| 3-quinuclidinone hydrochloride | 6 | 3 | 3 | 2 | 2.10 | 1.65 | 1.35 | 0.78 |
| 3-chloro-quinuclidine hydrochloride | 7 | 3 | 5 | 1.5 | 1.86 | 1.98 | 1.35 | 0.84 |
| 3-amino quinuclidine dihydrochloride | 7 | 2.5 | 5 | 1.5 | 1.60 | 1.68 | 1.40 | 0.80 |

-continued

| | Drying Time (minutes) | | | | Optical Density | | | |
|---|---|---|---|---|---|---|---|---|
| Additive | black | cyan | ma-genta | yel-low | black | cyan | ma-genta | yel-low |
| 4-amino quinaldine (methanol) | 5 | 2 | 2 | 1.5 | 1.74 | 1.45 | 1.66 | 0.96 |
| 8-hydroxy-quinaldine (methanol) | 5 | 2 | 2 | 1.5 | 1.60 | 1.95 | 1.30 | 0.97 |

As the results indicate, the drying times of the transparencies containing the additives were generally faster than the drying times of the transparency containing no additives. In addition, the optical densities of the images on the transparencies containing the additives were acceptable and in some instances improved compared to those on the transparencies containing no additives.

EXAMPLE IV

Paper recording sheets were prepared as follows. Coating compositions containing various additive compositions, each obtained from Aldrich Chemical Co., were prepared by dissolving 50 grams of the additive in 500 milliliters of water in a beaker and stirring for 1 hour at 25° C. The additive solutions thus prepared were then coated onto paper by a dip coating process (both sides coated in one operation) by providing paper base sheets in cut sheet form (8.5×11 inches) in a thickness of 100 microns. Subsequent to air drying at 100° C. for 10 minutes and monitoring the difference in weight prior to and subsequent to coating, the sheets were each coated on each side with 500 milligrams, in a thickness of 5 microns (total coating weight 1 gram for two-sided sheets), of the additive composition. For comparison purposes, an uncoated paper sheet treated with a composition containing only water by the same procedure was also imaged.

The paper sheets thus prepared were incorporated into a Hewlett-Packard 500–C color ink jet printer containing inks of the following composition:

| | |
|---|---|
| Cyan: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 30 percent by weight Projet Cyan 1 dye, obtained from ICI, 45.45 percent by weight water. |
| Magenta: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 2.5 percent by weight Triton Direct Red 227, obtained from Tricon, 72.95 percent by weight water. |
| Yellow: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water. |

Images were generated with 100 percent ink coverage. After the image was printed, the paper sheets were each weighed precisely in a precision balance at time zero and periodically after that. The difference in weight was recorded as a function of time, 100 minutes being considered as the maximum time required for most of the volatile ink components to evaporate. (Volatiles were considered to be ink components such as water and glycols that can evaporate, as compared to components such as dyes, salts, and/or other non-volatile components. Knowing the weight of ink deposited at time zero, the amount of volatiles in the image can be calculated.) After 1000 minutes, the curl values of the paper were measured and are listed in the Table below. The black images were "process black" (i.e., formed by superimposition of cyan, magenta, and yellow images).

| | Percent weight-loss of volatiles at various times (minutes) | | | | | | 1,000 minutes | |
|---|---|---|---|---|---|---|---|---|
| Additive | 5 | 10 | 15 | 30 | 60 | 120 | wt. loss % | curl in mm |
| none | 32 | 43 | 45 | 48 | 50 | 53 | 65 | 125 |
| 2-pyrrolidone-5-carboxylic acid | 34 | 46 | 50 | 55 | 58 | 60 | 73 | 30 |
| 1-aminopyrrolidine hydrochloride | 32 | 47 | 51 | 57 | 61 | 65 | 85 | 30 |
| L-proline methyl ester hydrochloride | 37 | 52 | 58 | 65 | 68 | 72 | 88 | 30 |
| 1-(4-chlorobenzy)-2-(1-pyrrolidinyl methyl) benzimidazole hydrochloride | 40 | 54 | 59 | 62 | 66 | 72 | 91 | 20 |
| 2-piperidine methanol | 36 | 51 | 57 | 63 | 66 | 69 | 99 | 25 |
| 2-piperidine carboxylic acid hydrochloride | 32 | 43 | 46 | 49 | 55 | 61 | 80 | 45 |
| 1-benzyl-3-piperidone hydrochloride hydrate | 31 | 37 | 40 | 45 | 52 | 58 | 81 | 45 |
| 2-iminopiperidine hydrochloride | 36 | 46 | 47 | 49 | 54 | 66 | 85 | 15 |
| 4,4'-bipiperidine dihydrochloride | 35 | 50 | 53 | 58 | 63 | 66 | 75 | 30 |
| 5,6,11,12-tetra hydrodibenz [b,f] azocine hydrochloride | 34 | 50 | 53 | 55 | 58 | 62 | 80 | 20 |
| 2-(2-piperidino ethyl) pyridine | 24 | 32 | 37 | 40 | 50 | 60 | 75 | 25 |
| 2-(2-methylamino ethyl) pyridine dihydrochloride | 33 | 45 | 49 | 52 | 54 | 56 | 75 | 10 |
| pyridoxamine dihydrochloride monohydrate | 36 | 52 | 57 | 62 | 65 | 68 | 91 | 10 |
| indole-2-carboxylic acid | 34 | 46 | 51 | 55 | 61 | 66 | 100 | 5 |
| indazole | 33 | 47 | 51 | 56 | 60 | 66 | 100 | 5 |
| tryptamine hydrochloride | 33 | 47 | 51 | 58 | 63 | 70 | 87 | 10 |
| harmane hydrochloride monohydrate (in methanol) | 33 | 48 | 53 | 58 | 60 | 65 | 81 | 15 |
| 4-hydroxyquinoline | 46 | 56 | 59 | 62 | 65 | 70 | 80 | 35 |
| 1,5-isoquinolinediol | 42 | 57 | 60 | 62 | 65 | 70 | 80 | 25 |
| 1-isoquinoline carboxylic acid | 39 | 50 | 54 | 60 | 62 | 75 | 86 | 50 |
| 8-hydroxyquinaldine | 42 | 55 | 59 | 64 | 69 | 73 | 100 | 30 |
| 4-aminoquinaldine | 19 | 33 | 39 | 43 | 46 | 50 | 76 | 50 |
| 1,2,3,4-tetrahydro isoquinoline hydrochloride | 31 | 45 | 49 | 52 | 55 | 60 | 91 | 10 |
| 1,2,3,4-tetrahydro-3-isoquinoline carboxylic acid hydrochloride | 36 | 47 | 50 | 55 | 59 | 65 | 70 | 20 |
| 2-(chloromethyl) quinoline monohydrochloride | 31 | 47 | 54 | 59 | 63 | 65 | 74 | 5 |
| 8-ethoxy-5-quinoline sulfonic acid, sodium salt hydrate | 36 | 47 | 49 | 52 | 55 | 60 | 85 | 20 |
| 3-chloroquinuclidine hydrochloride | 32 | 46 | 50 | 56 | 68 | 71 | 100 | 0 |
| 3-aminoquinuclidine dihydrochloride | 26 | 41 | 48 | 54 | 65 | 72 | 100 | 0 |
| 3-quinuclidinol hydrochloride | 35 | 49 | 53 | 58 | 60 | 62 | 75 | 45 |
| 3-quinuclidinone hydrochloride | 39 | 49 | 54 | 56 | 60 | 65 | 78 | 35 |
| neocuproine hydrochloride trihydrate | 35 | 48 | 52 | 57 | 58 | 63 | 91 | 55 |

As the results indicate, the papers coated with the additives exhibited higher weight loss of volatiles at time 1,000 minutes compared to the paper which had been treated with water alone. In addition, the papers coated with the additives exhibited lower curl values compared to the curl value for the paper treated with water alone.

EXAMPLE V

Paper recording sheets were prepared as follows. Coating compositions containing various additive compositions, each obtained from Aldrich Chemical Co., were prepared by dissolving 50 grams of the additive in 500 milliliters of water in a beaker and stirring for 1 hour at 25° C. The additive solutions thus prepared were then coated onto paper by a dip coating process (both sides coated in one operation) by providing paper base sheets in cut sheet form (8.5×11 inches) in a thickness of 100 microns. Subsequent to air drying at 100° C. for 10 minutes and monitoring the difference in weight prior to and subsequent to coating, the sheets were each coated on each side with 500 milligrams, in a thickness of 5 microns (total coating weight 1 gram for two-sided sheets), of the additive composition. For comparison purposes, an uncoated paper sheet treated with a composition containing only water by the same procedure was also imaged.

The paper sheets thus prepared were incorporated into a Hewlett-Packard 500–C color ink jet printer containing inks of the following composition:

| | |
|---|---|
| Cyan: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 30 percent by weight Projet Cyan 1 dye, obtained from ICI, 45.45 percent by weight water. |
| Magenta: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 2.5 percent by weight Triton Direct Red 227, obtained from Tricon, 72.95 percent by weight water. |
| Yellow: | 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, MI, 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water. |

The black images were "process black" (i.e., formed by superimposition of cyan, magenta, and yellow images). The optical densities for the resulting images were as follows:

What is claimed is:

1. A recording sheet which comprises a substrate and a coating substantially uniformly situated on at least one surface of the substrate, said coating comprising an additive material selected from the group consisting of pyrrole compounds and pyrrolidine compounds selected from the group consisting of (1) 2-acetyl-pyrrole; (2) 2-acetyl-1-methylpyrrole; (3) 3-acetyl-1-methylpyrrole; (4) 3-acetyl-2,4-dimethylpyrrole; (5) pyrrole-2-carboxaldehyde; (6) pyrrole-2-carboxylic acid; (7) 3-carboxy-1,4-dimethyl-2-pyrroleacetic acid; (8) proline amide; (9) 1-(pyrrolidino carbonylmethyl) piperazine; (10) 2-pyrrolidone-5-carboxylic acid; (11) 3-pyrrolidino-1,2-propane diol; (12) 1,1'-ethylene bis (5-oxo-3-pyrrolidine carboxylic acid); (13) kainic acid monohydrate; and mixtures thereof, pyridine compounds selected from the group consisting of (1) 2,6-pyridine dicarboxaldehyde; (2) 3,4-pyridine carboxamide; (3) 3,4-pyridine carboximide; (4) 2,3-pyridine carboxylic anhydride; (5) 3,4-pyridine carboxylic anhydride; (6) 2,6-pyridine methanol; (7) 2-pyridine ethane sulfonic acid; (8) 4-pyridine ethane sulfonic acid; (9) 3-pyridine sulfonic acid; (10) pyridoxic acid; (11) trans-3-(3-pyridyl) acrylic acid; (12) 2-pyridyl hydroxymethane sulfonic acid; (13) 3-pyridyl hydroxymethane sulfonic acid; (14) 6-methyl-2,3-pyridine dicarboxylic acid; (15) N,N-bis (2-hydroxyethyl) isonicotinamide; (16) 4,4'-trimethylene pyridine; (17) 2-(2-piperidinoethyl) pyridine; (18) 2-(chloromethyl) pyridine acid salts; (19) 2-pyridylacetic acid acid salts; (20) nicotinoyl chloride acid salts; (21) 2-hydrazinopyridine acid salts; (22) 2-(2-methyl aminoethyl) pyridine acid salts; (23) 1-methyl-1,2,3,6-tetrahydropyridine acid salts; (24) 2,6-dihydroxypyridine acid salts; (25) 3-hydroxy-2(hydroxymethyl) pyridine acid salts; (26) pyridoxine acid salts; (27) pyridoxal acid salts; (28) pyridoxal 5-phosphate acid salts; (29) 3-amino-2,6-dimethoxy pyridine acid salts; (30) pyridoxamine acid salts; (31) iproniazid acid salts; (32) tripelennamine acid salts; and mixtures thereof, piperidine compounds selected from the group consisting of (1) 2-piperidine methanol; (2) 3-piperidine methanol; (3) 2-piperidine ethanol; (4) 4-piperidine ethanol; (5) 3-piperidino-1,2-propane diol; (6) 1-piperidine propionic acid; (7) 2-piperidine carboxylic acid; (8) 4-piperidinopiperidine; (9) 4-phenyl piperidine; (10) 2,2,6,6-tetramethyl piperidine; (11) 2-piperidone; (12) 1-methyl-4-(methylamino) piperidine; (13) 4,4'-trimethylene bis (1-methyl piperidine); (14) 4,4'-trimethylene dipiperidine; (15) tris piperidinophosphine oxide; (16) 4,4'-trimethylene bis (1piperidine carboxamide); (17) 4,4'-trimethylene bis (1-piperidine propionitrile); (18) 4-methyl-2-(piperidinomethyl) phenol; (19) 1-methyl-4-piperidinyl bis(chlorophenoxy) acetate; and mixtures thereof homopiperidine compounds, quinoline compounds, isoquinoline compounds, indole compounds selected from the group consisting of (1) 4,5,6,7-tetrahydroindole; (2) 3-indolemethanol; (3) 3-indole ethanol; (4) indole-3-carboxaldehyde; (5) 3-indolylacetate; (6) indole-3-acetamide; (7) indole-3-carboxylic acid; (8) indole-3-acetic acid; (9) 3-indole propionic acid; (10) 3-indole acrylic acid; (11) 3-indole glyoxylic acid; (12) indole-3-pyruvic acid; (13) 3-indolelactic acid; (14) 3-indole butyric acid; (15) N-acetyl-tryptophanamide; (16) N-(3-indolylacetyl)-alanine; (17) N-(3-indolyl acetyl)-valine; (18) N-(3-indolyl acetyl)-isoleucine; (19) N-(3-indolyl acetyl)-leucine; (20) N-(3-indolyl acetyl)-aspartic acid; (21) N-(3-indolyl acetyl)-phenylalanine; (22) 4-hydroxyindole; (23) indole-4-carboxylic acid; (24) 4-indolyl acetate; (25) 4-methyl indole; (26) 5-hydroxy indole; (27) 5-hydroxy indole-3-acetic acid; (28) 5-hydroxy-2-indole carboxylic acid; (29) N-acetyl-5-hydroxytryptamine; (30) indole-5-carboxylic acid; (31) 5-methyl indole; (32) 5-methoxy indole; (33) indole-2-carboxylic acid; (34) indolene-2-carboxylic acid; (35) indole-2,3-dione; (36) 2-methyl indole; (37) 2,3,3-trimethyl indolenine; (38) tryptamine acid salts; (39) 5-methyl tryptamine acid salts; (40) serotonin acid salts; (41) norharman acid salts; (42) harmane acid salts; (43) harmine acid salts; (44) harmaline acid salts; (45) harmol acid salts; (46) harmalol acid salts; (47) 3,6-diamino acridine acid salts; (45) S-(3-indolyl) isothiuronium salts; (46) yohimbine acid salts; (47) 4,5-dihydro-3-(4-pyridinyl)-2H-benz(g) indazole methane acid salts; and mixtures thereof, indazole compounds, and mixtures thereof, wherein the recording sheet is suitable for receiving printed images, said substrate being selected from the group consisting of paper and transparent polymeric materials, said image receiving coating being suitable for receiving rapid drying images of an aqueous ink.

2. A recording sheet according to claim 1 wherein the additive material is present on the substrate in an amount of from about 1 to about 50 percent by weight of the substrate.

3. A recording sheet according to claim 1 wherein the additive material is present on the substrate in an amount of from about 0.8 to about 40 grams per square meter of the substrate.

4. A recording sheet according to claim 1 wherein the coating comprises a polysaccharide binder.

5. A recording sheet according to claim 1 wherein the coating comprises a quaternary acrylic copolymer latex binder.

6. A recording sheet according to claim 1 wherein a binder and the additive material are present in the coating in relative amounts of from about 10 percent by weight binder and about 90 percent by weight additive material to about 99 percent by weight binder and about 1 percent by weight additive material.

7. A recording sheet according to claim 1 wherein a binder and the additive material are coated onto the substrate in a thickness of from about 1 to about 25 microns.

8. A recording sheet according to claim 1 wherein the substrate is paper.

9. A recording sheet according to claim 1 wherein the substrate is a transparent polymeric material.

10. A recording sheet according to claim 1 wherein the additive is selected from the group consisting (1) 2,6-pyridine dicarboxaldehyde; (2) 3,4-pyridine carboxamide; (3) 3,4-pyridine carboximide; (4) 2,3-pyridine carboxylic anhydride; (5) 3,4-pyridine carboxylic anhydride; (6) 2,6-pyridine methanol; (7) 2-pyridine ethane sulfonic acid; (8) 4-pyridine ethane sulfonic acid; (9) 3-pyridine sulfonic acid; (10) pyridoxic acid; (11) trans-3-(3-pyridyl) acrylic acid; (12) 2-pyridyl hydroxymethane sulfonic acid; (13) 3-pyridyl hydroxymethane sulfonic acid; (14) 6-methyl-2,3-pyridine dicarboxylic acid; (15) N,N-bis (2-hydroxyethyl) isonicotinamide; (16) 4,4'-trimethylene pyridine; (17) 2-(2-piperidinoethyl) pyridine; and mixtures thereof.

11. A recording sheet according to claim 1 wherein the additive is selected from the group consisting of (1) 2-(chloromethyl) pyridine acid salts; (2) 2-pyridylacetic acid acid salts; (3) nicotinoyl chloride acid salts; (4) 2-hydrazinopyridine acid salts; (5) 2-(2-methyl aminoethyl) pyridine acid salts; (6) 1-methyl-1,2,3,6-tetrahydropyridine acid salts; (7) 2,6-dihydroxypyridine acid salts; (8) 3-hydroxy-2(hydroxymethyl) pyridine acid salts; (9) pyridoxine acid salts; (10) pyridoxal acid salts; (11) pyridoxal 5-phosphate acid salts; (12) 3-amino-2,6-dimethoxy pyridine acid salts; (13) pyridoxamine acid salts; (14) iproniazid acid salts; (15) tripelennamine acid salts; and mixtures thereof.

12. A recording sheet according to claim 1 wherein the additive is selected from the group consisting of (1) 2-piperidine methanol; (2) 3-piperidine methanol; (3) 2-piperidine ethanol; (4) 4-piperidine ethanol; (5) 3-piperidino1,2-propane diol; (6) 1-piperidine propionic acid; (7) 2-piperidine carboxylic acid; (8) 4-piperidinopiperidine; (9) 4-phenyl piperidine; (10) 2,2,6,6-tetramethyl piperidine; (11) 2-piperidone; (12) 1-methyl-4-(methylamino) piperidine; (13) 4,4'-trimethylene bis (1-methyl piperidine); (14) 4,4'-trimethylene dipiperidine; (15) tris piperidinophosphine oxide; (16) 4,4'-trimethylene bis (1-piperidine carboxamide); (17) 4,4'-trimethylene bis (1-piperidine propionitrile); (18) 4-methyl-2-(piperidinomethyl) phenol; (19) 1-methyl-4-piperidinyl bis (chlorophenoxy) acetate; and mixtures thereof.

13. A recording sheet according to claim 1 wherein the additive is a quinoline compound.

14. A recording sheet according to claim 1 wherein the additive is selected from the group consisting of (1) quinoline; (2) 2-hydroxyquinoline; (3) 4-hydroxy quinoline; (4) 5-hydroxy quinoline; (5) 8-hydroxy quinoline; (6) 3-amino quinoline; (7) 5-amino quinoline; (8) 6-amino quinoline; (9) 8-aminoquinoline; (10) 2-quinoline carboxylic acid; (11) 3-quinoline carboxylic acid; (12) 4-quinoline carboxylic acid; (13) 4-quinoline carboxaldehyde; (14) 2-quinoline thiol; (15) 2,4-quinoline diol; (16) quinaldine; (17) 8-hydroxyquinaldine; (18) 4-aminoquinaldine; (19) 2,6-dimethyl quinoline; (20) 2,7-dimethyl quinoline; (21) 4-methoxy-2-quinoline carboxylic acid; (22) 7,8-benzoquinoline; (23) methyl-2-phenyl-4-quinoline carboxylate; (24) 1,2,3,4-tetrahydro quinoline; (25) 6-ethoxy-1,2,3,4-tetrahydro-2,2,4-trimethyl quinoline; and mixtures thereof.

15. A recording sheet according to claim 1 wherein the additive is an isoquinoline compound.

16. A recording sheet according to claim 1 wherein the additive is selected from the group consisting of (1) 2-(N-butyl carbamoyl)-1,2,3,4-tetrahydro-isoquinoline; (2) 1-hydroxyisoquinoline; (3) 1-isoquinoline carboxylic acid; (4) 3-isoquinoline carboxylic acid; (5) 1,5-isoquinoline diol; and mixtures thereof.

17. A recording sheet according to claim 1 wherein the additive is selected from the group consisting of quinoline salt compounds and isoquinoline salt compounds.

18. A recording sheet according to claim 1 wherein the additive is selected from the group consisting of (1) 8-hydroxyquinoline acid salts; (2) 5-amino-8-hydroxy quinoline acid salts; (3) 2-(chloromethyl) quinoline acid salts; (4) 8-hydroxyquinoline-5-sulfonic acid salts; (5) 8-ethoxy-5-quinoline sulfonic acid salts; (6) 1,2,3,4-tetrahydroisoquinoline acid salts; (7) 1,2,3,4-tetrahydro-3-isoquinoline carboxylic acid acid salts; (8) 6,7-dimethoxy- 1,2,3,4-tetrahydro isoquinoline acid salts; (9) 1-methyl-6,7-dihydroxy-1,2,3,4-tetrahydro isoquinoline acid salts; (10) primaquine acid salts; (11) pentaquine acid salts; (12) dibucaine acid salts; (13) 9-aminoacridine acid salts; (14) 3,6-diamino acridine acid salts; (15) 2-quinoline thiol acid salts; (16) sparteine acid salts; (17) papaverine acid salts; (18) emetine acid salts; (19) 1,10-phenanthroline acid salts; (20) neocuproine acid salts; and mixtures thereof.

19. A recording sheet according to claim 1 wherein the additive is selected from the group consisting of (1) 4,5,6,7-tetrahydroindole; (2) 3-indolemethanol; (3) 3-indole ethanol; (4) indole-3-carboxaldehyde; (5) 3-indolylacetate; (6) indole-3-acetamide; (7) indole-3-carboxylic acid; (8) indole-3-acetic acid; (9) 3-indole propionic acid; (10) 3-indole acrylic acid; (11) 3-indole glyoxylic acid; (12) indole-3-pyruvic acid; (13) 3-indolelactic acid; (14) 3-indole butyric acid; (15) N-acetyl-tryptophanamide; (16) N-(3-indolylacetyl)-alanine; (17) N-(3-indolyl acetyl)-valine; (18) N-(3-indolyl acetyl)-isoleucine; (19) N-(3-indolyl acetyl)-leucine; (20) N-(3-indolyl acetyl)-aspartic acid; (21) N-(3-indolyl acetyl)-phenylalanine; (22) 4-hydroxyindole; (23) indole-4-carboxylic acid; (24) 4-indolyl acetate; (25) 4-methyl indole; (26) 5-hydroxy indole; (27) 5-hydroxy indole-3-acetic acid; (28) 5-hydroxy-2-indole carboxylic acid; (29) N-acetyl-5-hydroxytryptamine; (30) indole-5-carboxylic acid; (31) 5-methyl indole; (32) 5-methoxy indole; (33) indole-2-carboxylic acid; (34) indolene-2-carboxylic acid; (35)

indole-2,3-dione; (36) 2-methyl indole; (37) 2,3,3-trimethyl indolenine; and mixtures thereof.

20. A recording sheet according to claim 1 wherein the additive is an indazole compound.

21. A recording sheet according to claim 1 wherein the additive is selected from the group consisting of (1) indazole; (2) 5-aminoindazole; (3) 6-aminoindazole; (4) 3-indazolinone; (5) N'-(6-indazolyl) sulfanilamide; (6) 4,5-dihydro-3-(4-pyridinyl)-2H-benz(g) indazole methane sulfonate; and mixtures thereof.

22. A recording sheet according to claim 1 wherein the additive is selected from the group consisting of (1) tryptamine acid salts; (2) 5-methyl tryptamine acid salts; (3) serotonin acid salts; (4) norharman acid salts; (5) harmane acid salts; (6) harmine acid salts; (7) harmaline acid salts; (8) harmol acid salts; (9) harmalol acid salts; (10) 3,6-diamino acridine acid salts; (11) S-(3-indolyl) isothiuronium salts; (12) yohimbine acid salts; (13) 4,5-dihydro-3-(4-pyridinyl)-2H-benz(g) indazole methane acid salts; and mixtures thereof.

23. A recording sheet which consists essentially of a substrate, a coating substantially uniformly situated on at least one surface of the substrate and containing at least one additive material selected from the group consisting of pyrrole compounds and pyrrolidine compounds selected from the group consisting of (1) 2-acetyl-pyrrole; (2) 2-acetyl-1-methylpyrrole; (3) 3-acetyl-1-methylpyrrole; (4) 3-acetyl-2,4-dimethylpyrrole; (5) pyrrole-2-carboxaldehyde; (6) pyrrole-2-carboxylic acid; (7) 3-carboxy-1,4-dimethyl-2-pyrroleacetic acid; (8) proline amide; (9) 1-(pyrrolidino carbonylmethyl) piperazine; (10) 2-pyrrolidone-5-carboxylic acid; (11) 3-pyrrolidino-1,2-propane diol; (12) 1,1 '-ethylene bis (5-oxo-3-pyrrolidine carboxylic acid); (13) kainic acid monohydrate; and mixtures thereof, pyridine compounds selected from the group consisting of (1) 2,6-pyridine dicarboxaldehyde; (2) 3,4-pyridine carboxamide; (3) 3,4-pyridine carboximide; (4) 2,3-pyridine carboxylic anhydride; (5) 3,4-pyridine carboxylic anhydride; (6) 2,6-pyridine methanol; (7) 2-pyridine ethane sulfonic acid; (8) 4-pyridine ethane sulfonic acid; (9) 3-pyridine sulfonic acid; (10) pyridoxic acid; (11) trans-3-(3-pyridyl) acrylic acid; (12) 2-pyridyl hydroxymethane sulfonic acid; (13) 3-pyridyl hydroxymethane sulfonic acid; (14) 6-methyl-2,3-pyridine dicarboxylic acid; (15) N,N-bis (2-hydroxyethyl) isonicotinamide; (16) 4,4'-trimethylene pyridine; (17) 2-(2-piperidinoethyl) pyridine; (18) 2-(chloromethyl) pyridine acid salts; (19) 2-pyridylacetic acid acid salts; (20) nicotinoyl chloride acid salts; (21) 2-hydrazinopyridine acid salts; (22) 2-(2-methyl aminoethyl) pyridine acid salts; (23) 1-methyl-1,2,3,6-tetrahydropyridine acid salts; (24) 2,6-dihydroxypyridine acid salts; (25) 3-hydroxy-2(hydroxymethyl) pyridine acid salts; (26) pyridoxine acid salts; (27) pyridoxal acid salts; (28) pyridoxal 5-phosphate acid salts; (29) 3-amino-2,6-dimethoxy pyridine acid salts; (30) pyridoxamine acid salts; (31) iproniazid acid salts; (32) tripelennamine acid salts; and mixtures thereof, piperidine compounds selected from the group consisting of (1) 2-piperidine methanol; (2) 3-piperidine methanol; (3) 2-piperidine ethanol; (4) 4-piperidine ethanol; (5) 3-piperidino-1,2-propane diol; (6) 1-piperidine propionic acid; (7) 2-piperidine carboxylic acid; (8) 4-piperidinopiperidine; (9) 4-phenyl piperidine; (10) 2,2,6,6-tetramethyl piperidine; (11) 2-piperidone; (12) 1-methyl-4-(methylamino) piperidine; (13) 4,4'-trimethylene bis (1-methyl piperidine); (14) 4,4'-trimethylene dipiperidine; (15) tris piperidinophosphine oxide; (16) 4,4'-trimethylene bis (1-piperidine carboxamide); (17) 4,4'-trimethylene bis (1-piperidine propionitrile); (18) 4-methyl-2-(piperidinomethyl) phenol; (19) 1-methyl-4-piperidinyl bis(chlorophenoxy) acetate; and mixtures thereof, homopiperidine compounds, quinoline compounds, isoquinoline compounds, indole compounds selected from the group consisting of (1) 4,5,6,7-tetrahydroindole; (2) 3-indolemethanol; (3) 3-indole ethanol; (4) indole-3-carboxaldehyde; (5) 3-indolylacetate; (6) indole-3-acetamide; (7) indole-3-carboxylic acid; (8) indole-3-acetic acid; (9) 3-indole propionic acid; (10) 3-indole acrylic acid; (11) 3-indole glyoxylic acid; (12) indole-3-pyruvic acid; (13) 3-indolelactic acid; (14) 3-indole butyric acid; (15) N-acetyl-tryptophanamide; (16) N-(3-indolylacetyl)-alanine; (17) N-(3-indolyl acetyl)-valine; (18) N-(3-indolyl acetyl)-isoleucine; (19) N-(3-indolyl acetyl)-leucine; (20) N-(3-indolyl acetyl)-aspartic acid; (21) N-(3-indolyl acetyl)-phenylalanine; (22) 4-hydroxyindole; (23) indole-4-carboxylic acid; (24) 4-indolyl acetate; (25) 4-methyl indole; (26) 5-hydroxy indole; (27) 5-hydroxy indole-3-acetic acid; (28) 5-hydroxy-2-indole carboxylic acid; (29) N-acetyl-5-hydroxytryptamine; (30) indole-5-carboxylic acid; (31) 5-methyl indole; (32) 5-methoxy indole; (33) indole-2-carboxylic acid; (34) indolene-2-carboxylic acid; (35) indole-2,3-dione; (36) 2-methyl indole; (37) 2,3,3-trimethyl indolenine; (38) tryptamine acid salts; (39) 5-methyl tryptamine acid salts; (40) serotonin acid salts; (41) norharman acid salts; (42) harmane acid salts; (43) harmine acid salts; (44) harmaline acid salts; (45) harmol acid salts; (46) harmalol acid salts; (47) 3,6-diamino acridine acid salts; (48) S-(3-indolyl) isothiuronium salts; (49) yohimbine acid salts; (50) 4,5-dihydro-3-(4-pyridinyl)-2H-benz(g) indazole methane acid salts; and mixtures thereof, indazole compounds, and mixtures thereof an optional binder, an optional antistatic agent, an optional biocide, and an optional filler, wherein the recording sheet is suitable for receiving printed images, said substrate being selected from the group consisting of paper and transparent polymeric materials, said image receiving coating being suitable for receiving rapid drying images of an aqueous ink.

24. A recording sheet which comprises a substrate and a coating substantially uniformly situated on at least one surface of the substrate, said coating comprising an additive material which is a pyrrole compound, wherein the recording sheet is suitable for receiving printed images, said substrate being selected from The group consisting of paper and transparent polymeric materials, said image receiving coating being suitable for receiving rapid drying images of an aqueous ink.

25. A recording sheet which comprises a substrate and a coating substantially uniformly situated on at least one surface of the substrate, said coating comprising an additive material which is a pyrrolidine compound, wherein the recording sheet is suitable for receiving printed images, said substrate being selected from the group consisting of paper and transparent polymeric materials, said image receiving coating being suitable for receiving rapid drying images of an aqueous ink.

26. A recording sheet which comprises a substrate and a coating substantially uniformly situated on at least one surface of the substrate, said coating comprising an additive material selected from the group consisting at (1) 2-acetyl-pyrrole; (2) 2-acetyl-1-methylpyrrole; (3) 3-acetyl-1-methylpyrrole; (4) 3-acetyl-2,4-dimethylpyrrole; (5) pyrrole-2-carboxaldehyde; (6) pyrrole-2-carboxylic acid; (7) 3-carboxy-1,4-dimethyl-2-pyrroleacetic acid; (8) proline amide; (9) 1-(pyrrolidino carbonylmethyl) piperazine; (10)

2-pyrrolidone-5-carboxylic acid; (11) 3-pyrrolidino-1,2-propane diol; (12) 1,1'-ethylene bis (5-oxo-3-pyrrolidine carboxylic acid); (13) kainic acid monohydrate; and mixtures thereof, wherein the recording sheet is suitable for receiving printed images, said substrate being selected from the group consisting of paper and transparent polymeric materials, said image receiving coating being suitable for receiving rapid drying images of an aqueous ink.

27. A recording sheet which comprises a substrate and a coating substantially uniformly situated on at least one surface of the substrate, said coating comprising an additive which is a homopiperidine compound, wherein the recording sheet is suitable for receiving printed images, said substrate being selected from the group consisting of paper and transparent polymeric materials, said image receiving coating being suitable for receiving rapid drying images of an aqueous ink.

28. A recording sheet according to claim 27 wherein the additive is selected from the group consisting of (1) 2-(hexamethylene imino) ethyl chloride acid salts; (2) 3-(hexahydro-1 H-azepin-1-yl)-3'-nitropropiophenone acid salts; (3) imipramine acid salts; (4) carbamezepine; (5) 5,6,11,12-tetrahydro dibenz (b,f) azocine acid salts; and mixtures thereof.

* * * * *